US009170030B2

(12) United States Patent
Nagata et al.

(10) Patent No.: US 9,170,030 B2
(45) Date of Patent: Oct. 27, 2015

(54) STORAGE HOT WATER SUPPLYING APPARATUS, HOT WATER SUPPLYING AND SPACE HEATING APPARATUS, OPERATION CONTROL APPARATUS, OPERATION CONTROL METHOD, AND OPERATION CONTROL PROGRAM

(75) Inventors: Eiko Nagata, Osaka (JP); Gaku Hayashida, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1192 days.

(21) Appl. No.: 13/001,626

(22) PCT Filed: Apr. 19, 2010

(86) PCT No.: PCT/JP2010/002802
§ 371 (c)(1),
(2), (4) Date: Dec. 28, 2010

(87) PCT Pub. No.: WO2010/122759
PCT Pub. Date: Oct. 28, 2010

(65) Prior Publication Data

US 2011/0139259 A1 Jun. 16, 2011

(30) Foreign Application Priority Data

Apr. 21, 2009 (JP) ..... 2009-103455

(51) Int. Cl.
*F24H 1/18* (2006.01)
*E03B 1/00* (2006.01)
(Continued)

(52) U.S. Cl.
CPC *F24H 4/04* (2013.01); *F24D 3/082* (2013.01); *F24D 19/1069* (2013.01); *F24D 19/1072* (2013.01); *F24H 9/2007* (2013.01);
(Continued)

(58) Field of Classification Search
None
See application file for complete search history.

(56) References Cited

U.S. PATENT DOCUMENTS 3,958,555 A * 5/1976 Horne ..... 122/13.3
4,245,501 A * 1/1981 Feller ..... 374/41
(Continued)

FOREIGN PATENT DOCUMENTS

CA 2 578 389 8/2007
CN 1932405 3/2007
(Continued)

OTHER PUBLICATIONS

International Search Report issued Jun. 22, 2010 in International (PCT) Application No. PCT/JP2010/002802.
(Continued)

*Primary Examiner* — Gregory Huson
*Assistant Examiner* — Eric Gorman
(74) *Attorney, Agent, or Firm* — Wenderoth, Lind & Ponack, L.L.P.

(57) ABSTRACT

A storage hot water supplying apparatus provides heated water to a load circuit through which users uses water, and includes a water storage tank which stores water and has outlets for water to be heated at different heights, and an outlet selecting unit to select, from among the outlets, an outlet to take out the water, based on a provision temperature which is a temperature of water to be provided from the water storage tank to the load circuit and temperatures of the water to be taken out through the outlets. A heating unit heats the water taken out through the selected outlet and to be returned to the water storage tank.

15 Claims, 12 Drawing Sheets

(51) Int. Cl.

| | |
|---|---|
| ***F24H 4/04*** | (2006.01) |
| ***F24D 3/08*** | (2006.01) |
| ***F24D 19/10*** | (2006.01) |
| ***F24H 9/20*** | (2006.01) |

(52) U.S. Cl.

CPC ..... *F24D2220/042* (2013.01); *F24D 2220/06* (2013.01); *Y10T 137/0318* (2015.04); *Y10T 137/6416* (2015.04)

(56) References Cited

U.S. PATENT DOCUMENTS

| | | | | |
|---|---|---|---|---|
| 4,258,668 | A * | 3/1981 | Bekedam | 122/1 R |
| 4,397,294 | A * | 8/1983 | Mancebo | 126/597 |
| 4,832,259 | A * | 5/1989 | Vandermeyden | 236/20 R |
| 5,626,287 | A * | 5/1997 | Krause et al. | 236/20 R |
| 5,690,061 | A * | 11/1997 | Lopez | 122/14.3 |
| 5,908,560 | A * | 6/1999 | Elliott, Jr. | 210/759 |
| 8,461,493 | B1 * | 6/2013 | Cantolino et al. | 219/494 |
| 2005/0022542 | A1 * | 2/2005 | Sakakibara | 62/183 |
| 2005/0077368 | A1 * | 4/2005 | Zak et al. | 237/19 |
| 2005/0111991 | A1 * | 5/2005 | Chida et al. | 417/207 |
| 2005/0284949 | A1 * | 12/2005 | Minnella et al. | 237/19 |
| 2006/0173653 | A1 * | 8/2006 | Chian et al. | 702/182 |
| 2006/0230772 | A1 * | 10/2006 | Wacknov et al. | 62/199 |
| 2007/0107674 | A1 * | 5/2007 | Choi | 122/7 R |
| 2007/0186872 | A1 | 8/2007 | Shellenberger et al. | |
| 2008/0022946 | A1 * | 1/2008 | Inami et al. | 122/14.21 |
| 2008/0314999 | A1 * | 12/2008 | Strand | 236/20 R |
| 2009/0101085 | A1 * | 4/2009 | Arensmeier et al. | 122/14.22 |
| 2009/0239108 | A1 * | 9/2009 | Miyauchi et al. | 429/13 |
| 2010/0089339 | A1 * | 4/2010 | Krause et al. | 122/19.1 |
| 2010/0229583 | A1 * | 9/2010 | Komori et al. | 62/238.7 |
| 2010/0294021 | A1 * | 11/2010 | Makino et al. | 73/25.03 |
| 2011/0061418 | A1 * | 3/2011 | Ishihara et al. | 62/324.3 |
| 2011/0305444 | A1 * | 12/2011 | Pussell | 392/308 |
| 2012/0067300 | A1 * | 3/2012 | Berrio | 122/14.3 |
| 2012/0118554 | A1 * | 5/2012 | Mathur et al. | 165/287 |
| 2013/0140015 | A1 * | 6/2013 | Hayashida | 165/200 |
| 2013/0205814 | A1 * | 8/2013 | Hayashida | 62/115 |
| 2013/0220591 | A1 * | 8/2013 | Hayashida | 165/287 |
| 2013/0337352 | A1 * | 12/2013 | Miyauchi et al. | 429/416 |

FOREIGN PATENT DOCUMENTS

| | | | | |
|---|---|---|---|---|
| CN | 101101147 | | 1/2008 | |
| EP | 0819893 | A2 * | 7/1997 | F24D 11/003 |
| EP | 0 819 893 | A2 | 1/1998 | |
| JP | 60-202252 | | 10/1985 | |
| JP | 2004-183920 | | 7/2004 | |
| JP | 2004-347179 | | 12/2004 | |
| JP | 2006-046803 | | 2/2006 | |
| JP | 2006-343012 | | 12/2006 | |
| JP | 3868924 | | 1/2007 | |
| JP | 2007-046879 | | 2/2007 | |
| JP | 2007-232345 | | 9/2007 | |
| JP | 2007-278553 | | 10/2007 | |
| JP | 2008-281282 | | 11/2008 | |
| JP | 2009-186065 | | 8/2009 | |

OTHER PUBLICATIONS

Extended European Search Report issued May 2, 2014 in corresponding European Application No. 10766821.2.

* cited by examiner

STORAGE HOT WATER SUPPLYING APPARATUS, HOT WATER SUPPLYING AND SPACE HEATING APPARATUS, OPERATION CONTROL APPARATUS, OPERATION CONTROL METHOD, AND OPERATION CONTROL PROGRAM

BACKGROUND OF INVENTION

1. Technical Field

The present invention relates to a storage hot water supplying apparatus which heats water in a water storage tank and supplies hot water using the heated water stored in the water storage tank.

2. Background Art

When heating water in the water storage tank, a conventional storage hot water supplying apparatus transmits low-temperature water in a lower part of the water storage tank using a heating unit pump through an outlet to a heating unit, such as a heat pump, heats the low-temperature water to a high temperature using the heating unit, and provides the high-temperature water to an upper part of the water storage tank, so that temperature of the water in the water storage tank is raised to a high-temperature gradually from the water in the upper part, and eventually the whole of the storage tank.

The high-temperature water stored in the water storage tank is used for hot water supply, space heating, bathwater reheating, and the like. In particular, the heat of the high-temperature water stored in the water storage tank is absorbed by a radiator or a heat exchanger and used for space heating or bathwater reheating, so that the water cools down to medium temperatures before it returns to the water storage tank.

The high-temperature water in the water storage tank may cool down to medium temperatures with time because of heat loss. The medium-temperature water, which has been used for space heating or bathwater reheating, accumulates in the lower part of the water storage tank. The conventional storage hot water supplying apparatus therefore transmits the medium-temperature water to the heating unit to reheat it.

It is a general property of a heat pump used as a heating unit that energy efficiency (a coefficient of performance (COP)) deteriorates when the heat pump is provided with water having a medium temperature which is relatively high from a water storage tank.

In view of this, a storage hot water supplying apparatus has been presented which is provided with a subtank between a water storage tank and a heating unit. The water at medium temperatures is cooled down to a low temperature in the subtank, and then sent to the heating unit, allowing a heat pump as a heat source apparatus to constantly operate with high efficiency (for example, see PTL 1).

Still another storage hot water supplying apparatus has been presented which has a configuration in which hot water to be used for hot water supply is taken out of a middle part of a water storage tank and water used for heating is returned to the middle part of the water storage tank. In this configuration, the temperature of the water in a lower part of the water storage tank is maintained low due to difference between water at different temperatures in relative density. This suppresses the increase of medium-temperature water, thereby heating water with high efficiency (for example, see PTL 2).

Still another storage hot water supplying apparatus has been presented which has a configuration in which medium-temperature water is taken out of a middle part of a water storage tank and actively used for heating, and heating of water is controlled according to a temperature or a flow rate necessary for space heating (for example, see PTL 3).

CITATION LIST

Patent Literature

[PTL 1] Japanese Unexamined Patent Application Publication No. 2006-343012

[PTL 2] Japanese Patent No. 3868924

[PTL 3] Japanese Unexamined Patent Application Publication No. 2007-232345

SUMMARY OF INVENTION

However, there is a problem that the conventional storage hot water supplying apparatuses operate inefficiently in a manner described as follows.

The energy efficiency (COP), which has been an object of improvement, has been generally derived from efficiency in performance of a heat pump (=performance of (or the amount of heat generated by) the heat pump/the amount of heat consumed by the heat pump), or from an annual performance factor (APF) (=the amount of heat of hot water consumed annually/the amount of electricity required annually), which gauges the efficiency of hot water supply taking into account conditions of actual use by users. In addition, energy efficiency is also evaluated using efficiency of an apparatus in actual operation (=the amount of heat used for handling the load/the power consumption required for handling the load), taking into account the amount of heat used not only for hot water supply but also for heating.

High-temperature water stored in the water storage tank loses more heat with time. When the high-temperature water in the water storage tank is consumed for handling a load such as hot water supply, space heating, or bathwater reheating, lower-temperature makeup water is supplied to the water storage tank, or water cooled down to a lower temperature due to heat consumption is returned to the water storage tank. Such operations generate middle-temperature water, thus reducing the amount of heat stored in the water storage tank.

In the calculation of the efficiency of an apparatus in actual operation, the "power consumption required for handling the load" includes power for heating water to be stored in the water storage tank using the heat pump. Therefore, wasteful heating, excessive heating, or inefficient heating of medium-temperature water leads to deterioration in the efficiency of an actual apparatus in operation.

On the other hand, the water storage tank stores water which has a positive (>0) amount of heat but is not usable for handling the load because the temperature of the water is inappropriate. As the water not usable for handling the load due to its inappropriate temperature increases in the water storage tank, the usable amount of heat, that is, available heat in the water storage tank decreases. In other words, when the water storage tank stores a large amount of medium-temperature water, the water storage tank is likely to also store a large amount of water not usable for handling the load due to its inappropriate temperature.

In view of this, it is significant to efficiently heat water with suppressed increase in the amount of water which is in the water storage tank but not usable for handling the load due to its inappropriate temperature, and to increase the amount of increase in available heat. However, there is a problem that the conventional storage hot water supplying apparatuses operate inefficiently, because the amount of water not usable for handling the load due to its inappropriate temperature is so large that available heat in the water storage tank is small.

The present invention, conceived to address the problem; has an object of providing a storage hot water supplying apparatus which efficiently operates with a large increase in available heat in the water storage tank.

In order to solve the problem with the conventional techniques, the storage hot water supplying apparatus according to an aspect of the present invention provides heated water to a load portion through which a user uses water, the storage hot water supplying apparatus including: a water storage tank which stores water and is provided with a plurality of water outlets through which the water is taken out, the water outlets being positioned at different levels of the water storage tank; an outlet selecting unit configured to select, from among the water outlets, a water outlet through which to take out the water, based on a provision temperature which is a temperature of water to be provided from the water storage tank to the load portion and temperatures of the water to be taken out through the water outlets; and a heating unit configured to heat the water taken out through the selected water outlet and to be returned to the water storage tank.

In the aspect of the present invention, a water outlet is selected based on the provision temperature and the temperature to be taken out through the water outlets, and the water taken out through the selected water outlet is heated. Here, the provision temperature is a temperature of water to be provided to the load portion, that is, a temperature of water which can be effectively used for handling a load. For example, water having a temperature lower than the provision temperature is water not usable for handling a load is. The water stored in the water storage tank but not usable for handling a load due to its temperature is taken out through the water outlet selected based on the provision temperature, and then heated. This suppresses increase in the amount of water which is in the water storage tank but is not usable for handling the load due to its inappropriate temperature, and produces a large increase in available heat, thereby allowing the storage hot water supplying apparatus to efficiently operate.

Furthermore, it is preferable that the outlet selecting unit be configured to select, from among the water outlets, a water outlet through which to take out water having a temperature lower than the provision temperature. Specifically, the outlet selecting unit preferably selects a water outlet through which to take out water having a temperature lower than and closest to the provision temperature.

In this aspect of the present invention, the water outlet selected from among the water outlets allows taking out of the water having a temperature lower than and closest to the provision temperature. Such selection of a water outlet is efficiently made through a simple comparison. This suppresses increase in the amount of water not usable for handling the load due to its inappropriate temperature in the water storage tank, and produces a large increase in available heat in the water storage tank, thereby allowing the storage hot water supplying apparatus to efficiently operate.

Furthermore, the outlet selecting unit may be configured to select a water outlet which provides a largest coefficient of performance (COP), the COP indicating energy efficiency in heating of water by the heating unit and being calculated using an assumed amount of heat which is smaller than an actual amount of water having a temperature lower than the provision temperature. Specifically, the outlet selecting unit may include: a heat amount increase calculating unit configured to calculate, for each of the water outlets, an increase in an amount of heat of the water to be taken out through the water outlet due to heating of the water by the heating unit, the increase being calculated based on an assumption that an amount of heat of the water is zero in the case where the water has a temperature lower than the provision temperature, a COP calculating unit configured to calculate, for each of the water outlets, a COP corresponding to the calculated increase in the amount of heat; and a selecting unit configured to select a water outlet for which the calculated COP is largest among the water outlets.

In this aspect of the present invention, the COPs are calculated based on an assumption that an amount of available heat of the water is zero in the case where the water has a temperature lower than the provision temperature, and the water outlets which provides the largest COP among is selected. That is, the COPs are calculated based on an assumption that an amount of heat of the water not usable for handling a load is zero. Thus, a water outlet which provides the highest efficiency is selected in accordance with properties of a heat pump, thereby increasing the available heat in the water storage tank at maximum efficiency.

Furthermore, the present invention may be implemented not only as such a storage hot water supplying apparatus but also as a space and water heating apparatus which includes the units included in the storage hot water supplying apparatus, an operation control apparatus which controls the storage hot water supplying apparatus, or as a method which includes the units included in the apparatuses as steps. It is also possible to implement the present invention as a program that causes a computer to execute the steps, as a computer medium, such as a computer-readable CD-ROM, on which the program is recorded, and as information, data, or a signal that represents the program. The program, the information, the data, and the signal may be distributed via a communication network, such as the Internet.

According to the present invention, a storage hot water supplying apparatus which efficiently operates is provided. The storage hot water supplying apparatus operates with efficiency increased against a load (efficiency of an apparatus in actual operation) by efficiently heating water which is in a water storage tank but cannot be effectively used and producing a large increase in available heat in the water storage tank.

DETAILED DESCRIPTION OF INVENTION

Embodiment 1

The following describes a storage hot water supplying apparatus according to Embodiment 1 of the present invention with reference to the drawings.

Figure 1:
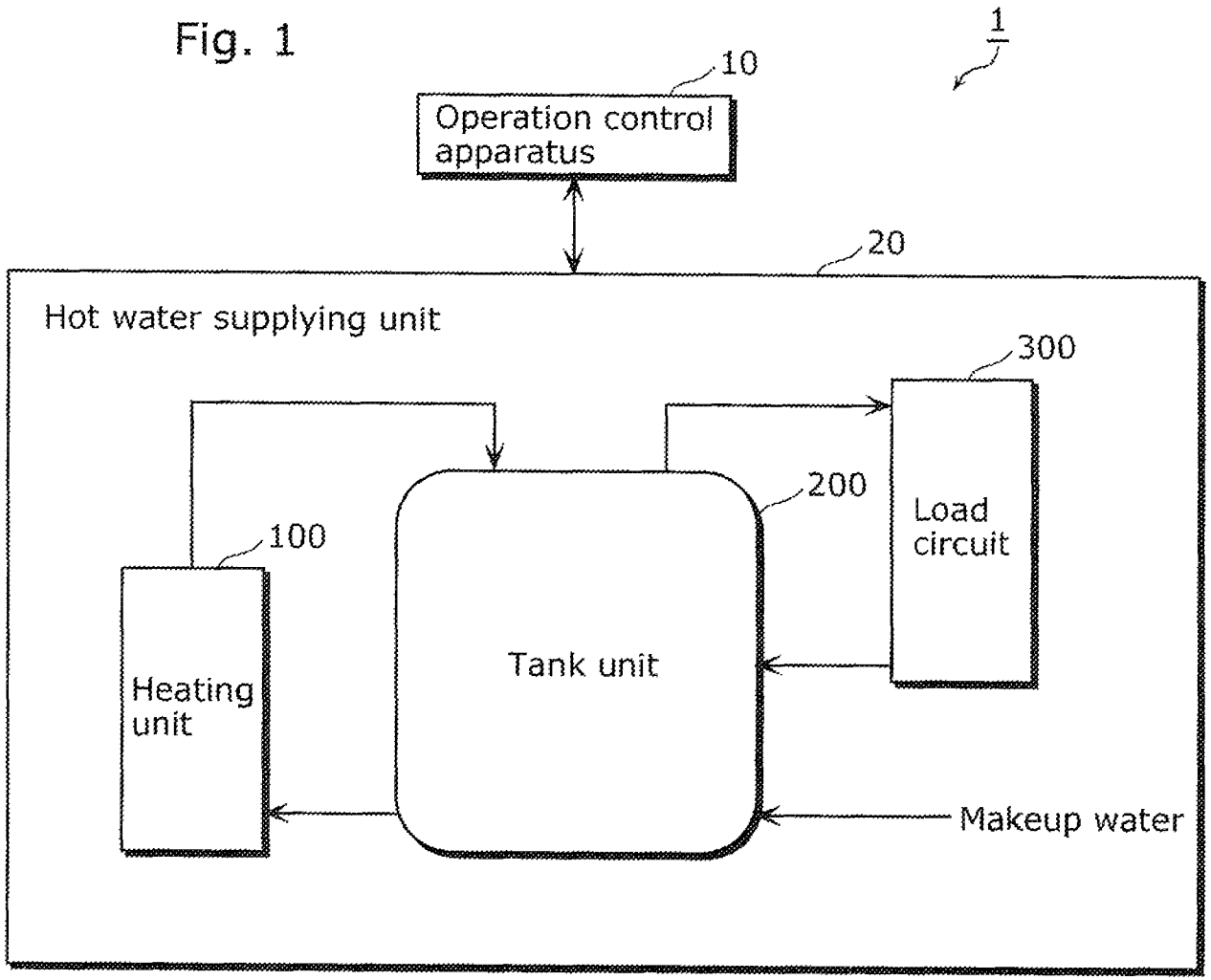
FIG. 1 is a schematic view illustrating a storage hot water supplying apparatus according to Embodiment 1 of the present invention.

FIG. 1 is a schematic view illustrating a storage hot water supplying apparatus 1 according to Embodiment 1 of the present invention.

The storage hot water supplying apparatus 1 is an apparatus which supplies hot water for use by users. As shown in FIG. 1, the storage hot water supplying apparatus 1 includes an operation control apparatus 10 and a hot water supplying unit 20.

The operation control apparatus 10 controls operation of the storage hot water supplying apparatus 1. Specifically, the operation control apparatus 10 controls operation of the storage hot water supplying apparatus 1 to allow the storage hot water supplying apparatus 1 to efficiently operate with largely increased available heat in a water storage tank. The operation control apparatus 10 will be described in detail later.

Under the control by the operation control apparatus 10, the hot water supplying unit 20 heats water and supplies the heated water for use by users. The hot water supplying unit 20 includes a heating unit 100, a tank unit 200, and a load circuit 300.

The heating unit 100 includes a heating device such as a heat pump to heat water.

The tank unit 200 includes a water storage tank to store water. Specifically, the water stored in the tank unit 200 is to be heated by the heating unit 100, and the heated water is returned to the tank unit 200. In addition, when the water is consumed and decreased, makeup water is supplied to the tank unit 200 so that the amount of water stored in the tank unit 200 keeps a predetermined level.

The load circuit 300 is a circuit which allows the user to use the water. Specifically, the load circuit 300 includes an apparatus which supplies water to the user or an apparatus which allows the user to heat a space or reheat bathwater. The water stored in the tank unit 200 is provided to the load circuit 300 according to an instruction of the user, and part of the used water is returned to the tank unit 200. It is to be noted that the load circuit 300 corresponds to a "load portion" in Claims.

The following describes the hot water supplying unit 20 in detail.

Figure 2:
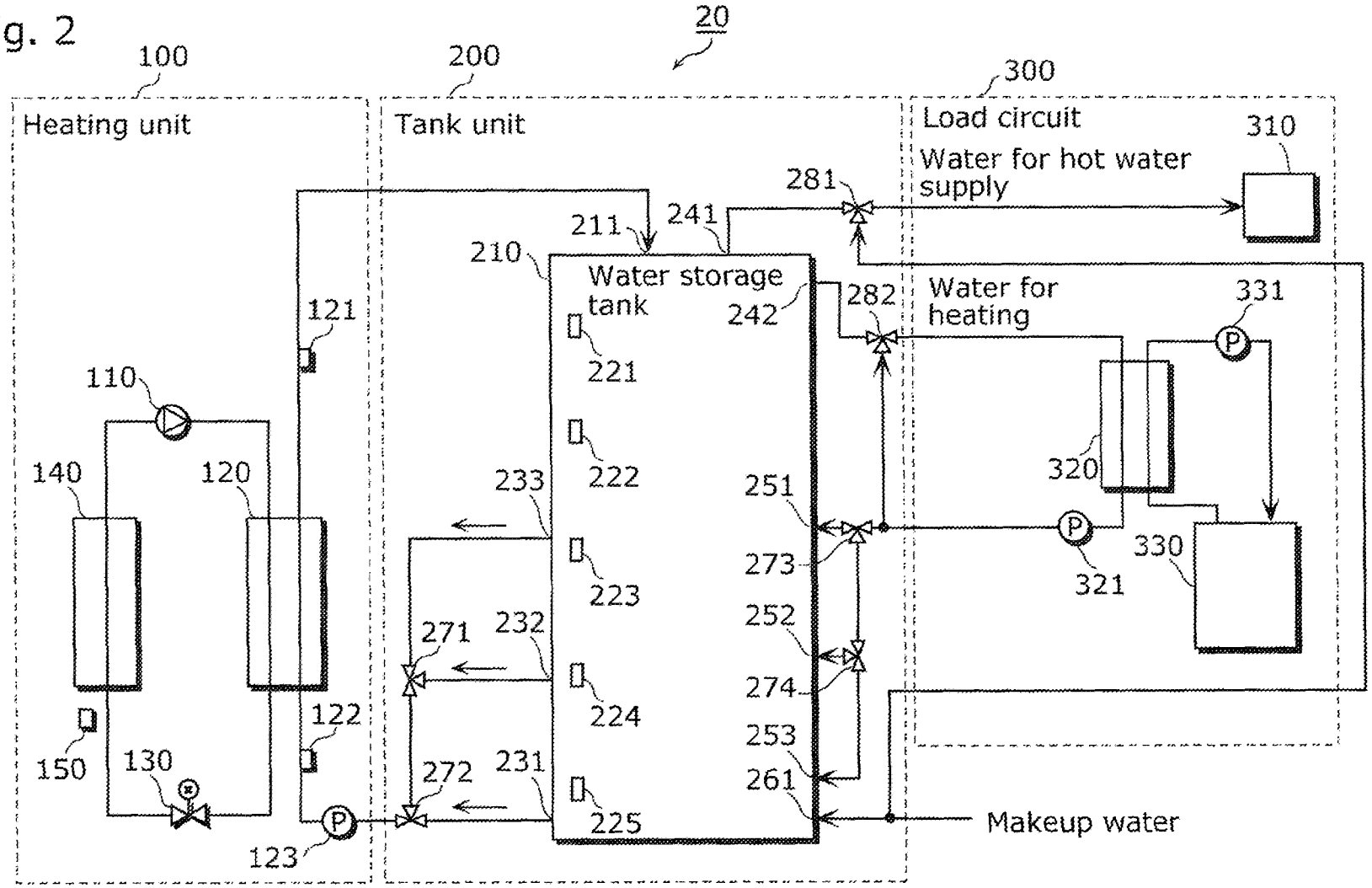
FIG. 2 is a schematic view illustrating a configuration of a hot water supplying unit according to Embodiment 1 of the present invention.

FIG. 2 is a schematic view illustrating a configuration of the hot water supplying unit 20 according to Embodiment 1 of the present invention.

As shown in FIG. 2, the heating unit 100 includes a compressor 110, a water heat exchanger 120, an expansion valve 130, an air heat exchanger 140, and a heating unit pump 123. The heating unit 100 heats water, which has been taken out of the tank unit 200 and is to be returned to the tank unit 200, using the water heat exchanger 120 to provide high-temperature water.

Furthermore, the heating unit 100 is provided with an outside air temperature sensor 150 which senses outside air temperature, an incoming water temperature sensor 122 which is located on a path from a water outlet of the tank unit 200 to a water inlet of the water heat exchanger 120, and an outgoing water temperature sensor 121 on a path from an water outlet of the water heat exchanger 120.

The tank unit 200 includes a water storage tank 210 which stores water, three-way valves 271 to 274, and mixing valves 281 and 282. The tank unit 200 provides the water stored in the water storage tank 210 to the heating unit 100 and the load circuit 300, and stores water returned from the heating unit 100 and the load circuit 300 in the water storage tank 210.

Furthermore, the water storage tank 210 includes a plurality of outlets for water to be heated 231 to 233 (hereinafter referred to as "outlets for water to be heated 1 to 3", respectively), a heated-water inlet 211, a hot water supplying load outlet 241, an makeup water inlet 261, a circulating hot water outlet 242, and a plurality of a circulating hot water inlets 251 to 253 (hereinafter referred to as "circulating hot water inlets 1 to 3", respectively).

Here, the heated-water inlet 211 is positioned higher than the outlets for water to be heated 1 to 3. The hot water supplying load outlet 241 is positioned higher than the circulating hot water inlets 1 to 3. The makeup water inlet 261 is positioned lower than the circulating hot water inlets 1 to 3. In this configuration, the water in the water storage tank 210 tends to be thermally stratified. Here, the higher the water is in the water storage tank 210, the higher the temperature of the water is. It is to be noted that the position relations among these inlets and outlets are not limited to this. These inlets and outlets may be arranged otherwise.

Here, the outlets for water to be heated 1 to 3 are outlets for taking out water at different heights in the water storage tank 210. It is to be noted that although the water storage tank 210 is provided with the three outlets for water to be heated 1 to 3, the water storage tank 210 may be provided with any number of outlets for water to be heated equal to or larger than two. It is to be noted that the outlets for water to be heated 1 to 3 correspond to "water outlets" in Claims.

Similarly, the circulating hot water inlets 1 to 3 are inlets which allow water to return into the water storage tank 210 at different heights thereof. It is also to be noted that although the water storage tank 210 is provided with the three circulating hot water inlets 1 to 3, the water storage tank 210 may be provided with any number of circulating hot water inlets.

Furthermore, the water storage tank 210 includes a plurality of temperature sensors which sense the temperature of the water at different heights ranging from a lower part to an upper part of the water storage tank 210. In this embodiment, it is assumed that the water storage tank 210 is provided with the five temperature sensors 221 to 225. Here, the temperature sensors 223 to 225 sense the temperature of the water to be taken out through the respective outlets for water to be heated 1 to 3. It is to be noted that the temperature sensors 223 to 225 are included in "water temperature sensing units" in Claims.

In this configuration, the compressor 110, the water heat exchanger 120, the expansion valve 130, and the air heat exchanger 140 form a coolant circuit. In addition, the outlets for water to be heated 1 to 3 (the outlets for water to be heated 231 to 233) of the water storage tank 210, the water heat exchanger 120, and the heated-water inlet 211 of the water storage tank 210 form a water heating circuit. The heating unit pump 123 circulates water through the water heating circuit, so that the water taken out through the outlets for water to be heated 1 to 3 exchanges heat with the coolant in the water heat exchanger 120 to be high-temperature water and is returned to the heated-water inlet 211 of the water storage tank 210.

The three-way valves 271 and 272 on the water heating circuit switch between water heating paths according to a selection of an outlet for water to be heated from among the outlets for water to be heated 1 to 3 of the water storage tank 210.

Specifically, when, for example, the outlet for water to be heated 1 is selected, the three-way valves 271 and 272 switch to a water heating path which allows water from the outlet for water to be heated 1 (the outlet for water to be heated 231) of the water storage tank 210 to flow through the water heating circuit and to be heated therein. When, for example, the outlet for water to be heated 2 is selected, the three-way valves 271 and 272 switch to a water heating path which allows water from the outlet for water to be heated 2 (the outlet for water to be heated 232) of the water storage tank 210 to flow through the water heating circuit and to be heated therein.

Water is thus taken out through the selected one of the outlets for water to be heated 1 to 3, heated by the heating unit 100, and then returned to the water storage tank 210.

The water stored in the water storage tank 210 is provided to the load circuit 300, in which part of the water is consumed. The water storage tank 210 therefore is provided with makeup water to maintain the amount of the water in the water storage tank 210.

The load circuit 300 includes a hot water supplying unit 310 to which water is provided, a circulating hot water heat exchanger 320 which exchanges heat of circulated water for space heating or bathwater reheating, a space-heating and bathwater-reheating unit 330 which heats space or reheat bathwater, a hot water circulating pump 321, and a space-heating and bathwater-reheating pump 331.

The hot water supplying unit 310 is provided with water (hereinafter referred to as "water for hot water supply") prepared by the mixing valve 281 by mixing the high-temperature water provided from the hot water supplying load outlet 241 of the water storage tank 210 and the makeup water, so that water having a predetermined temperature is supplied to a user. Here, the predetermined temperature of the water for hot water supply is a temperature set by the user through a remote control.

That is, high-temperature water is taken out through the hot water supplying load outlet 241, and the high-temperature water is mixed with water having a temperature lower than that of the high-temperature water by the mixing valve 281. The water mixed by the mixing valve 281 is then provided to the hot water supplying unit 310 of the load circuit 300.

On the other hand, space heating and bathwater reheating are carried out by exchanging heat between the high-temperature water, which is provided from the circulating hot water outlet 242 of the water storage tank 210 and circulated at a predetermined circulation rate by the hot water circulating pump 321, and circulated water for space heating and bathwater reheating through the circulating hot water heat exchanger 320.

Here, the circulating hot water outlet 242 of the water storage tank 210, the circulating hot water heat exchanger 320, and the circulating hot water inlets 1 to 3 (the circulating hot water inlets 251 to 253) form a hot water circulation path, and the hot water circulating pump 321 circulates water through the hot water circulation path.

After the heat exchange in the circulating hot water heat exchanger 320, part of the hot water passes through a bypass circuit, and is then mixed with high-temperature water provided from the circulating hot water outlet 242 of the water storage tank 210 in order to adjust the temperature of hot water to be sent to the circulating hot water heat exchanger 320 (hereinafter referred to as "water for heating") to a predetermined temperature. Here, the predetermined temperature of the water for heating is a temperature such as set by a user through a remote control or indicated by a level of, for example, high or low set by a user.

On the other hand, hot water not flowing into the bypass circuit is returned to the water storage tank 210. In this returning, the temperature sensors 221 to 225 in the water storage tank 210 sense the temperature of the water stored in the water storage tank 210, and an inlet through which the hot water is returned into the water storage tank 210 is selected, based on the sensed temperature, from the circulating hot water inlets 1 to 3 so that the hot water returns through an inlet which is closer to water having a temperature closer to that of the returning hot water.

The three-way valves 273 and 274 on the hot water circulation path are valves for switching water circulation paths according to a selection of a circulating hot water inlet from the circulating hot water inlets 1 to 3 of the water storage tank 210.

Specifically, when, for example, the circulating hot water inlet 1 is selected, the three-way valves 273 and 274 switch to a hot water circulation path which allows the hot water to return to the circulating hot water inlet 1 of the water storage tank 210. When, for example, the circulating hot water inlet 2 is selected, the three-way valves 273 and 274 switch to a hot water circulation path which allows the hot water to return to the circulating hot water inlet 2 of the water storage tank 210.

The amount of heat of a hot water supplying load is calculated by using the flow rate of the water for hot water supply provided to the hot water supplying unit 310 and the temperature of the water for hot water supply resulting from mixing the high-temperature water from the water storage tank 210 and the makeup water. Similarly, the amount of heat consumed for space heating and bathwater reheating is calculated by using the flow rate of the water for heating flowing in the hot water circulation path and the temperatures of the water for heating before and after flowing through the circulating hot water heat exchanger 320.

The circulating hot water heat exchanger 320 and the space-heating and bathwater-reheating unit 330 may be radiators for purposes such as space heating.

In this configuration, the heating unit pump 123 and the compressor 110 are controlled by the operation control apparatus 10 while the heating unit 100 is performing heating operation to heat water. For example, when a target temperature, which is a temperature to which water is heated, is 90° C., the operation control apparatus 10 adjusts the flow rate of water flowing through the heating unit pump 123 so that the outgoing water temperature sensor 121 senses a temperature of 90° C. The temperature of the outgoing water is controlled also by controlling the rotation speed of the compressor 110 or opening of the expansion valve 130. Through this operation, the water at 90° C. gradually accumulates in the water storage tank 210 from the top thereof. When the incoming water temperature sensor 122 senses a predetermined temperature, for example, a temperature of 60° C., the operation control apparatus 10 determines that the 90° C. water has accumulated up to the bottom of the water storage tank 210, and then stops the heating unit pump 123 and the compressor 110 to terminate the heating operation.

The following describes a functional configuration of the operation control apparatus included in the storage hot water supplying apparatus according to Embodiment 1.

Figure 3:
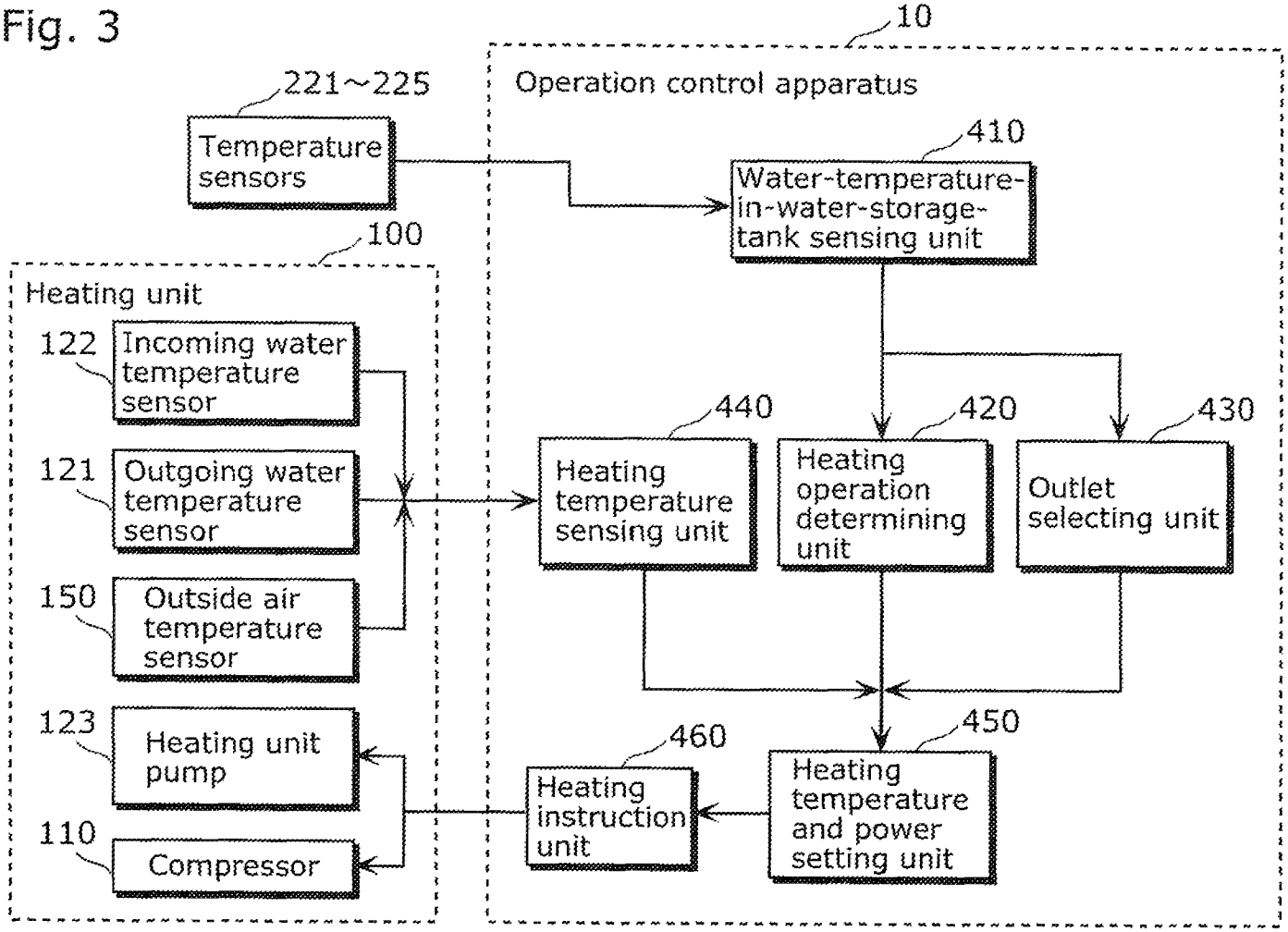
FIG. 3 is a functional block diagram showing a functional configuration of an operation control apparatus according to Embodiment 1 of the present invention.

FIG. 3 is a functional block diagram showing a functional configuration of the operation control apparatus 10 according to Embodiment 1 of the present invention.

As shown in FIG. 3, the operation control apparatus 10 includes a water-temperature-in-water-storage-tank sensing unit 410, a heating operation determining unit 420, an outlet selecting unit 430, a heating temperature sensing unit 440, a heating temperature and power setting unit 450, and a heating instruction unit 460.

The water-temperature-in-water-storage-tank sensing unit 410 determines the temperature of the water in the water storage tank 210. Specifically, the water-temperature-in-water-storage-tank sensing unit 410 determines the temperature of the water in the water storage tank 210 through the temperature sensors 221 to 225 provided in the water storage tank 210.

The heating temperature sensing unit 440 determines the temperature of the water before and after being heated by the heating unit 100. Specifically, the heating temperature sensing unit 440 obtains temperatures sensed by the incoming water temperature sensor 122, the outgoing water temperature sensor 121, and the outside air temperature sensor 150 of the heating unit 100.

The outlet selecting unit 430 selects, from among the outlets for water to be heated 1 to 3, an outlet for water to be heated through which to take out the water, based on a provision temperature which is the temperature of water to be provided from the water storage tank 210 to the load circuit 300 and temperatures of the water to be taken out through the outlets for water to be heated 1 to 3. In other words, the outlet selecting unit 430 selects from among the outlets for water to be heated 1 to 3 formed on the water storage tank 210 in order to take out water to be heated by the heating unit 100. The outlet selecting unit 430 will be described in detail later.

It is to be noted that the provision temperature is specifically a temperature set for water for hot water supply or water for heating to be provided to the load circuit 300.

In other words, the provision temperature is a lower limit of temperature of water usable for handling a load. In other words, the water at temperatures below the provision temperature is not usable for handling a load.

The heating operation determining unit 420 determines start and stop of the heating operation by the heating unit 100 based on the temperature determined by the water-temperature-in-water-storage-tank sensing unit 410. Specifically, the heating operation determining unit 420 determines whether or not the heating unit 100 needs to be started and how long the heating operation needs to be continued, based on the temperature determined by the water-temperature-in-water-storage-tank sensing unit 410, and, when the heating unit 100 is performing a heating operation, determines whether or not the heating operation needs to be stopped based on the temperature determined by the water-temperature-in-water-storage-tank sensing unit 410.

The heating temperature and power setting unit 450 sets a heating temperature and a heating power of the heating unit 100 at which the heating unit 100 heats the water, based on the temperature determined by the water-temperature-in-water-storage-tank sensing unit 410, the temperature determined by the heating temperature sensing unit 440, the result of the determination made by the heating operation determining unit 420, and the outlet for water to be heated selected by the outlet selecting unit 430. Specifically, the heating temperature and power setting unit 450 sets a target temperature and powers of the heating unit pump 123 and the compressor 110 based on the temperature of water determined by the water-temperature-in-water-storage-tank sensing unit 410, the outlet for water to be heated selected by the outlet selecting unit 430, the result of determination made by the heating operation determining unit, and information on the temperature determined by the heating temperature sensing unit 440.

The heating instruction unit 460 instructs the heating unit 100 to heat the water which is taken out through the selected outlet for water to be heated and to be returned to the water storage tank 210.

Then, the heating unit 100 heats the water at the set heating temperature and heating powers according to the instruction. That is, the heating unit 100 heats the water to the target temperature at the power of the heating unit pump 123 and the compressor 110 set by the heating temperature and power setting unit 450.

The following describes the outlet selecting unit 430 in detail.

Figure 4:
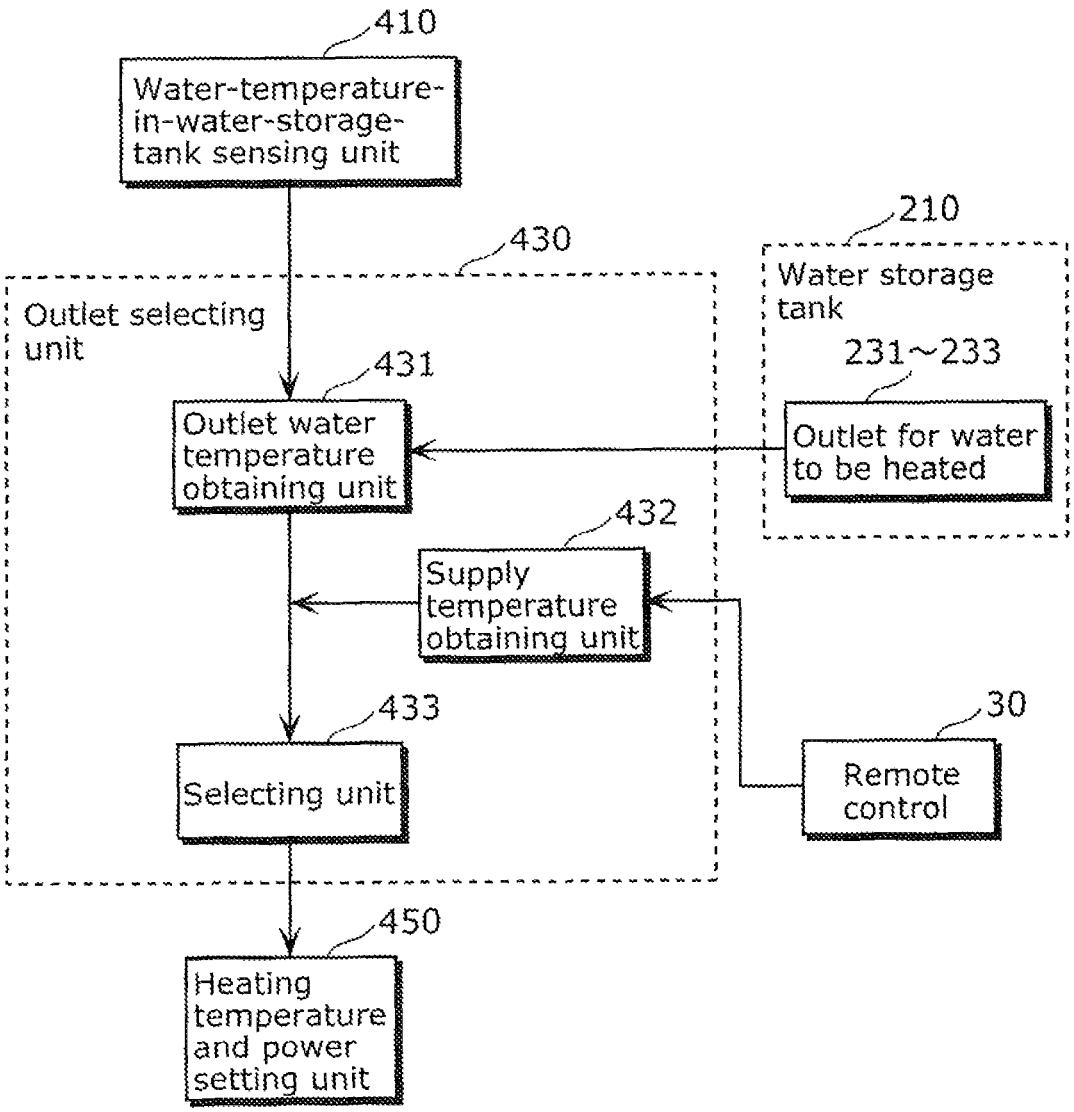
FIG. 4 is a functional block diagram showing a detailed functional configuration of an outlet selecting unit according to Embodiment 1 of the present invention.

FIG. 4 is a functional block diagram showing a detailed functional configuration of the outlet selecting unit 430 according to Embodiment 1 of the present invention.

As shown in FIG. 4, the outlet selecting unit 430 includes an outlet water temperature obtaining unit 431, a provision temperature obtaining unit 432, and a selecting unit 433.

The outlet water temperature obtaining unit 431 calculates temperatures of water in the vicinity of the outlets for water to be heated 1 to 3 from the temperature determined by the water-temperature-in-water-storage-tank sensing unit 410 and the positions of the outlets for water to be heated 1 to 3 in the water storage tank 210. Here, the outlet water temperature obtaining unit 431 obtains temperatures of the water to be taken out through the outlets for water to be heated 1 to 3.

The provision temperature obtaining unit 432 obtains a provision temperature. Here, the provision temperature is a temperature set for the water for hot water supply or the water for heating. In the case where temperatures set for the water for hot water supply and the water for heating are different, the provision temperature may be the lowest one of the temperatures set for the water for hot water supply and the water for heating. The provision temperature obtaining unit 432 obtains, as the provision temperature, a user's input of a temperature or input of level set for the water for hot water supply or the water for heating to the storage hot water supplying apparatus 1 through a remote control.

That is, the remote control 30 is a device which receives a temperature set for the water for hot water supply or the water for heating and sets the received temperature as a provision temperature. It is to be noted that the remote control 30 is included in a "provision temperature setting unit" in Claims.

In this manner, temperatures of water in the water storage tank 210 are estimated by the temperature sensors 223 to 225, and the provision temperature is obtained from the temperature setting which a user actually sets through the remote control 30. This allows taking the water not effectively usable for handling a load out of the water storage tank 210 with higher accurately.

The selecting unit 433 selects, from among the outlets for water to be heated 1 to 3, an outlet for water to be heated through which to take out the water, based on the temperatures of the water to be taken out through the outlets for water to be heated 1 to 3 and the provision temperature. Specifically, the selecting unit 433 selects, from among the outlets for water to be heated 1 to 3, an outlet for water to be heated through which to take out water having a temperature lower than the provision temperature. More specifically, the outlet selecting unit 430 selects, from among the outlets for water to be heated through which to take out water having temperatures lower than the provision temperature, an outlet for water to be heated through which to take out water having a temperature lower than and closest to the provision temperature.

The following describes an exemplary operation of the operation control apparatus 10 of the storage hot water supplying apparatus 1.

Figure 5:
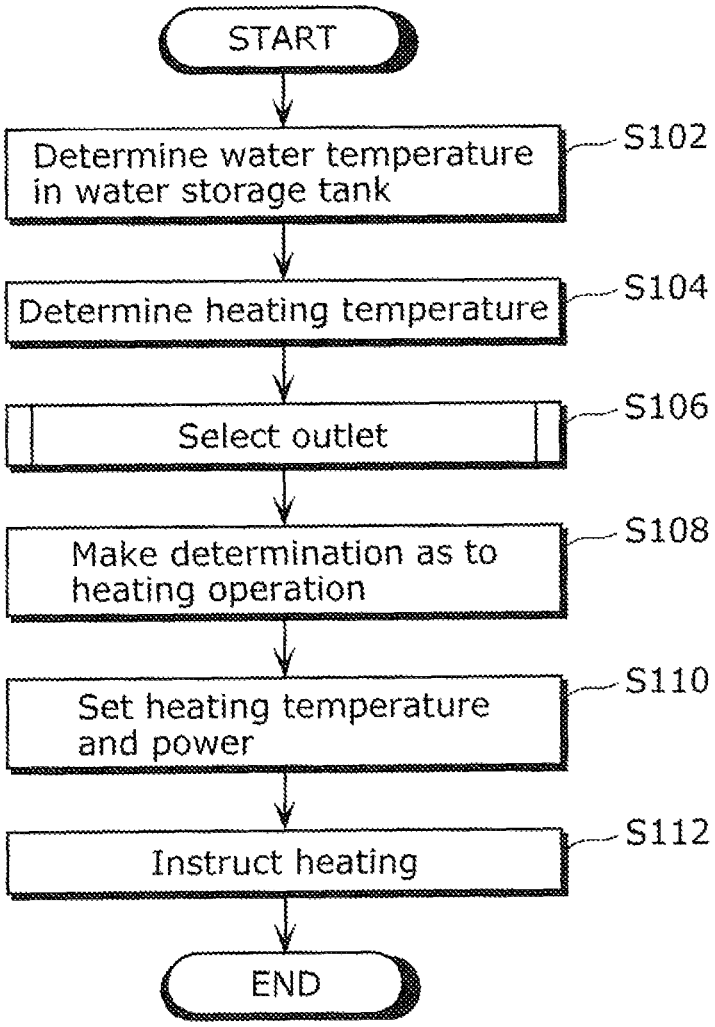
FIG. 5 is a flow chart showing an exemplary operation of the storage hot water supplying apparatus according to Embodiment 1 of the present invention.

FIG. 5 is a flow chart showing an exemplary operation of the storage hot water supplying apparatus 1 according to Embodiment 1 of the present invention.

First, as shown in FIG. 5, the water-temperature-in-water-storage-tank sensing unit 410 determines the temperature of the water in the water storage tank 210 (S102).

Next, the heating temperature sensing unit 440 determines the temperature sensed by the incoming water temperature sensor 122, the outgoing water temperature sensor 121, and the outside air temperature sensor 150 (S104).

Next, the outlet selecting unit 430 selects, from among the outlets for water to be heated 1 to 3, an outlet for water to be heated through which to take out the water, based on a provision temperature and temperatures of water to be taken out through the outlets for water to be heated 1 to 3 (S106). The process of selecting an outlet for water to be heated by the outlet selecting unit 430 will be described in detail later.

Next, the heating operation determining unit 420 determines start and stop of the heating operation by the heating unit 100, based on the temperature sensed by the water-temperature-in-water-storage-tank sensing unit 410 (S108).

Next, the heating temperature and power setting unit 450 sets a heating temperature and a heating power of the heating unit 100 at which the heating unit 100 heats the water, based on the temperature determined by the water-temperature-in-water-storage-tank sensing unit 410, the temperature determined by the heating temperature sensing unit 440, the result of the determination made by the heating operation determining unit 420, and the outlet for water to be heated selected by the outlet selecting unit 430 (S110).

Next, the heating instruction unit 460 instructs the heating unit 100 to heat the water which is taken out through the selected outlet for water to be heated and to be returned to the water storage tank 210 (S112). Then, the heating unit 100 heats the water at the set heating temperature and heating power according to the instruction.

The operation performed by the operation control apparatus 10 of the storage hot water supplying apparatus 1 is thus completed.

The following describes a process of selecting an outlet for water to be heated by the outlet selecting unit 430 (S106 in FIG. 5) in detail.

Figure 6:
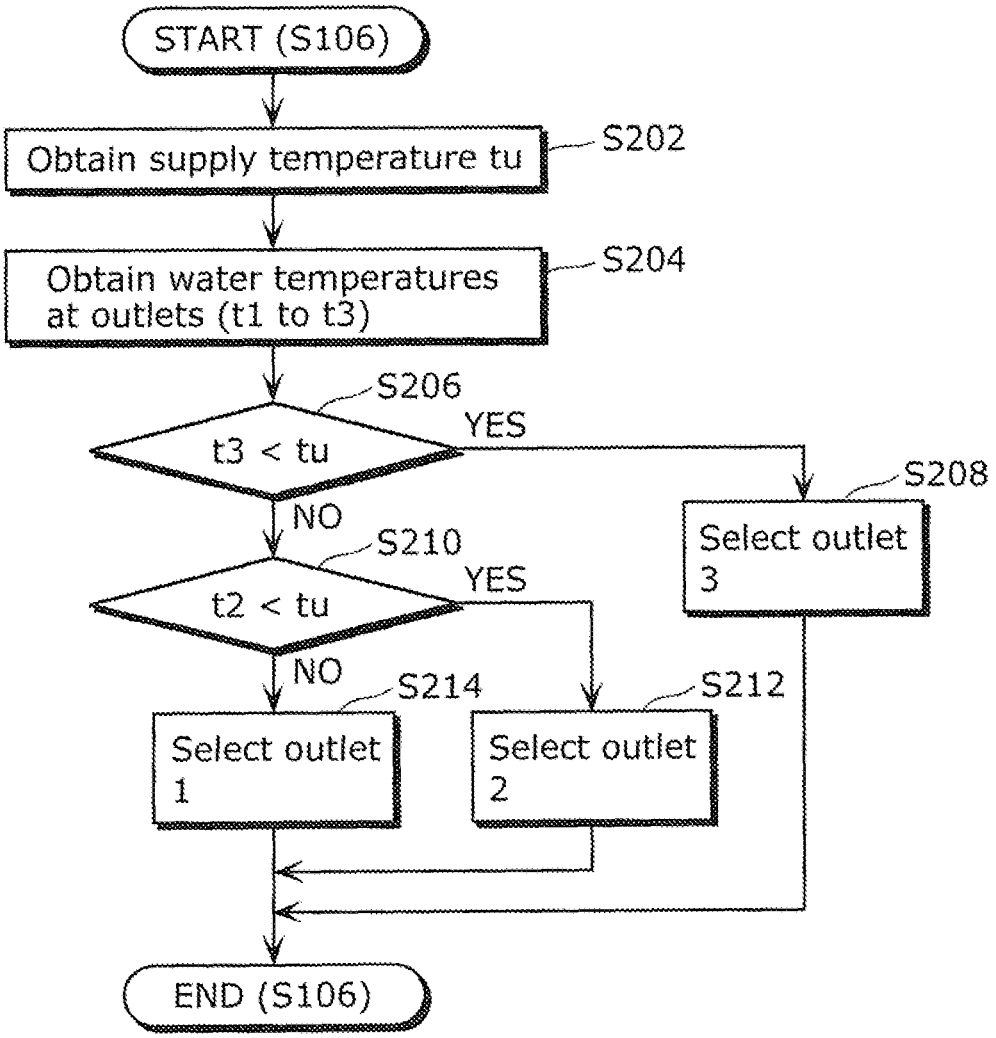
FIG. 6 is a flow chart showing an exemplary process of selecting an outlet for water to be heated performed by an outlet selecting unit according to Embodiment 1 of the present invention.

FIG. 6 is a flow chart showing an exemplary process of selecting an outlet for water to be heated performed by the outlet selecting unit 430 according to Embodiment 1 of the present invention (S106 in FIG. 5).

Figure 7:
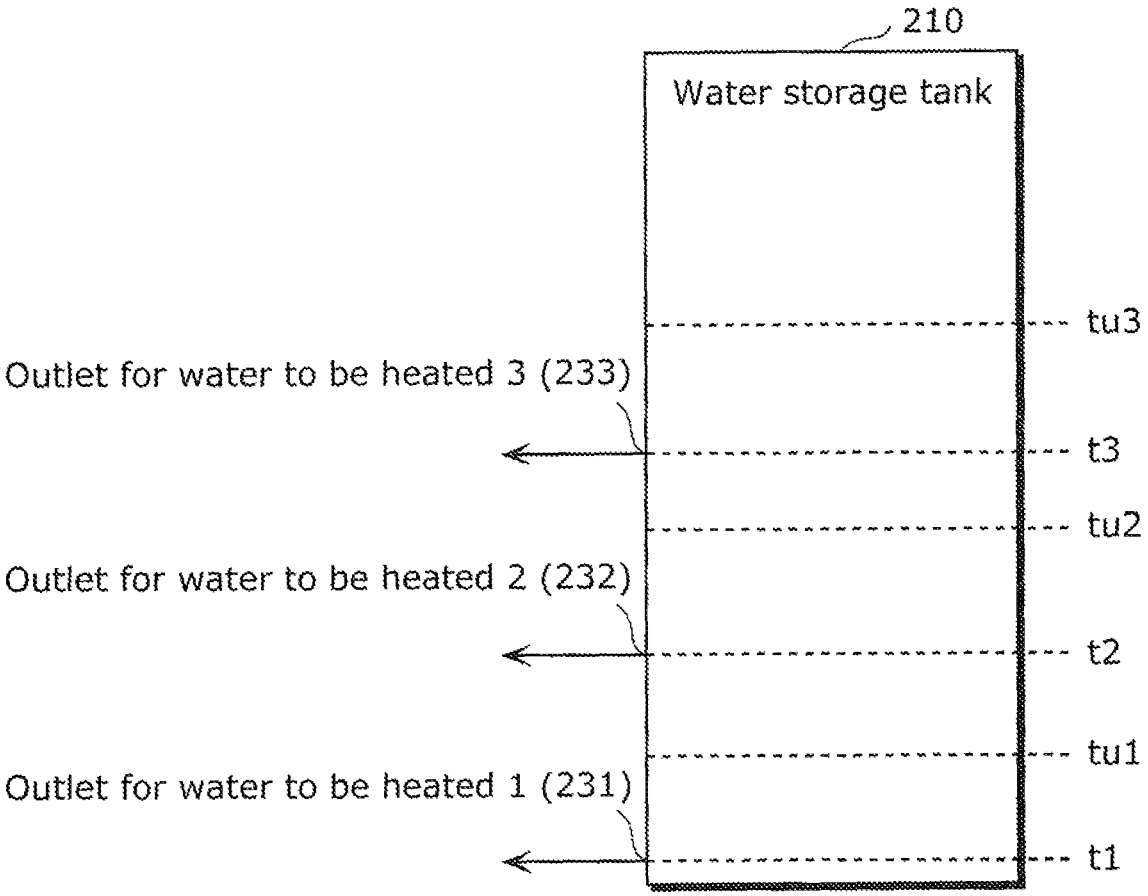
FIG. 7 shows the process of selecting an outlet for water to be heated by the outlet selecting unit according to Embodiment 1 of the present invention.

FIG. 7 shows the process of selecting an outlet for water to be heated by the outlet selecting unit 430.

First, referring to FIG. 6, the provision temperature obtaining unit 432 obtains a provision temperature to (S202).

Next, the outlet water temperature obtaining unit 431 obtains a temperature of water at each of the outlets for water to be heated based on the temperature of water determined by the water-temperature-in-water-storage-tank sensing unit 410 (S204). That is, the outlet water temperature obtaining unit 431 obtains temperatures of the water to be taken out through the outlets for water to be heated 1 to 3 (t1 to t3).

Here, the outlet water temperature obtaining unit 431 may obtain, as temperatures of water at the outlets for water to be heated, the temperatures sensed by the temperature sensors 221 to 225 which is closest to the respective outlets for water to be heated, or may calculate temperatures of water at the outlets for water to be heated from the temperatures sensed by the temperature sensors 221 to 225 and positions of the temperature sensors 221 to 225 in the water storage tank 210.

Next, the selecting unit 433 selects, from among the outlets for water to be heated 1 to 3, an outlet for water to be heated through which to take out the water. Specifically, the outlet selecting unit 430 selects, from among the outlets for water to be heated 1 to 3, an outlet for water to be heated through which to take out water having a temperature lower than and closest to the provision temperature.

Specifically, the selecting unit 433 makes a comparison between the temperature t3 of water to be taken out through the outlet for water to be heated 3 and the provision temperature tu (S206).

When determining the temperature t3 of water to be taken out through the outlet for water to be heated 3 is below the provision temperature tu (YES in S206), the selecting unit 433 selects the outlet for water to be heated 3 (S208). For example, referring to FIG. 7, in the case where the provision temperature tu is set to the provision temperature tu3 shown in FIG. 7, the water temperature t3 at the outlet for water to be heated 3 is below the provision temperature tu3. Then, the selecting unit 433 determines that the water temperature t3 at the outlet for water to be heated 3 is below the provision temperature tu3, and selects the outlet for water to be heated 3 (outlet for water to be heated 233).

Referring to FIG. 6 again, when determining that the temperature t3 of water at the outlet for water to be heated 3 is equal to or above the provision temperature t3 (NO in S206), the selecting unit 433 makes a comparison between the temperature t2 of water to be taken out through the outlet for water to be heated 2 and the provision temperature tu (S210).

When determining that the temperature t2 of water at the outlet for water to be heated 2 is below the provision temperature tu (YES in S210), the selecting unit 433 selects the outlet for water to be heated 2 (S212). For example, referring to FIG. 7, in the case where the provision temperature tu is set to the provision temperature tu2 shown in FIG. 7, the water temperature t3 at the outlet for water to be heated 3 is equal to or above the provision temperature tu2, and the water temperature t2 at the outlet for water to be heated 2 is below the provision temperature tu2. Then; the selecting unit 433 determines that the water temperature t2 at the outlet for water to be heated 2 is below the provision temperature tu2, and selects the outlet for water to be heated 2 (outlet for water to be heated 232).

Referring to FIG. 6 again, when determining that the temperature t2 of water at the outlet for water to be heated 2 is equal to or above the provision temperature tu (NO in S210), the selecting unit 433 selects the outlet for water to be heated 1 (S214). For example, referring to FIG. 7, in the case where the provision temperature tu is set to the provision temperature tu1 shown in FIG. 7, the water temperature t2 at the outlet for water to be heated 2 is equal to or above the provision temperature tu1. Then, the selecting unit 433 determines that the water temperature t2 at the outlet for water to be heated 2 is equal to or above the provision temperature tu1, and selects the outlet for water to be heated 1 (outlet for water to be heated 231).

The selecting unit 433 thus selects, from among the outlets for water to be heated 1 to 3, an outlet for water to be heated through which to take out water having a temperature lower than and closest to the provision temperature.

It is to be noted that although the temperature comparison, is started with the outlet for water to be heated 3, which is located in the upper part of the water storage tank 210, on a condition that the water in the water storage tank 210 is thermally stratified, it is preferable to select an outlet for water to be heated through which to take out water having a temperature lower than and closest to the provision temperature in the case where there is a possibility that the water in the water storage tank 210 is not thermally stratified.

It is to be noted that when the water in the water storage tank 210 is thermally stratified, the values sensed by the temperature sensors 223 to 225 decreases from top to bottom (here, the temperature sensed by the temperature sensor 223 is highest), and when the water in the water storage tank 210 is not thermally stratified, a value sensed by a temperature sensor closer to the top of the water storage tank 210 is lower than a value sensed by a temperature sensor closer to the bottom.

The process of selecting an outlet for water to be heated performed by the outlet selecting unit 430 (S106 in FIG. 5) is thus completed.

The following describes advantageous effects produced by selecting an outlet for water to be heated in this manner by the outlet selecting unit 430.

Figure 8:
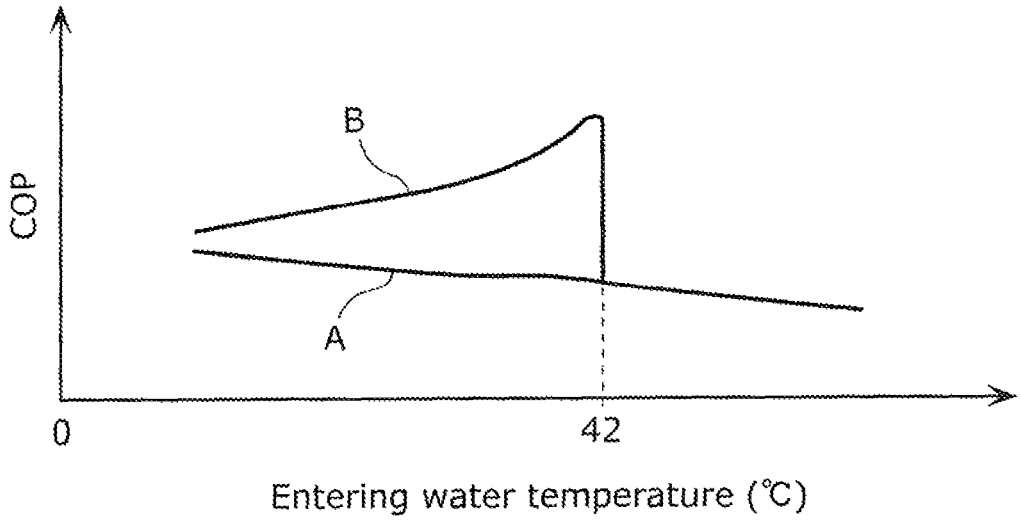
FIG. 8 shows COPs of a heating unit with respect to temperatures of water entering the heating unit.

FIG. 8 shows COPs of the heating unit 100 with respect to temperatures of water entering the heating unit 100, at a given outside air temperature and a given heating temperature. Specifically, FIG. 8 shows a graph having a horizontal axis which represents temperatures of the water entering the heating unit 100 (entering water temperature), and a vertical axis which represents COPs of the heating unit 100.

Here, it is assumed that the temperature of the water entering the heating unit 100 is the same as the temperature of the water taken out through the outlets for water to be heated 1 to 3 of the water storage tank 210. It is also assumed that the provision temperature is set to 42° C. That is, FIG. 8 shows COPs of the heating unit 100 with respect to the temperatures of water in the water storage tank 210 when the provision temperature is set to 42° C.

The following describes a method of calculating the COPs.

First, the amount of heat of the water stored in the water storage tank 210 is calculated from the temperatures determined by the water-temperature-in-water-storage-tank sensing unit 410 and the positions of the temperature sensors 221 to 225.

Next, a heat increase, which is an increase in the amount of heat of water due to heating of the water by the heating unit 100, is calculated from the temperature of the water sensed by the temperature sensor closest from the selected outlet for water to be heated, a target temperature to which the water is heated to by the heating unit 100, and a flow rate. At this time, the heat increase due to the heating of the water amounts the difference between the target temperature and the temperature of the water in the water storage tank 210.

Then, a COP is calculated by dividing the heat increase per unit time by the power consumed by the heating unit 100. The power is calculated from values such as the water temperature entering the heating unit 100, the target temperature, and the outside air temperature. Alternatively, the power may be measured using a power meter.

The COPs with respect to the amount of generated heat (hereinafter referred to as "rated COPs") are thus calculated and represented by a graph A shown in FIG. 8.

The following describes a graph B shown in FIG. 8.

The water at the provision temperature is supplied to the load circuit 300 and used for handling a load such as hot water supply or space heating, thus water having a temperature lower than the provision temperature is not usable for such loads. In view of this, an available heat, which is the amount of heat of the water in the water storage tank 210, is calculated based on an assumption that the amount of heat of the water having a temperature lower than the provision temperature is zero. That is, the available heat is the amount of heat of the water usable for handling a load such as hot water supply or space heating.

In other words, an available heat increase, which is an increase in the amount of heat of water due to heating of the water having a temperature lower than the provision temperature by the heating unit 100, is the amount of heat due to heating of the water by the heating unit 100 to the target temperature. The closer to the provision temperature the temperature of the water to be heated by the heating unit 100 is, the larger the increase in available heat is.

In addition, it is properties of a heat pump that a heat pump is likely to require less power for heating a certain amount of water to a certain temperature when the temperature to be raised is smaller, and that a heat pump is likely to produce more hot water with the same power when the temperature to be raised is smaller. In other words, the higher the temperature of water entering the heating unit 100 is, the less the power required for heating the water is, and the larger the available heat increase is.

Thus, the closer to the provision temperature the entering water temperature is, the larger the COP with respect to the available heat increase (hereinafter referred to as an "actual COP") is. That is, an actual COP is calculated by dividing an available heat increase of water having temperatures equal to or above a provision temperature (hereinafter referred to as "useful temperatures") by power consumed by the heating unit 100, on a condition that only water at useful temperatures is usable for handling a load such as hot water supply or space heating.

Actual COPs calculated in this manner are represented by a graph B shown in FIG. 8.

As shown in FIG. 8, the actual COP may not be high even when the rated COP is high, and, in the case where the entering water temperature is lower than the provision temperature (42° C.), the actual COP is high even when the rated COP is low. Specifically, the actual COP is high when the entering water temperature is lower than the provision temperature, and the closer to the provision temperature the entering water temperature is, the larger the actual COP is.

Therefore, the outlet selecting unit 430 selects an outlet for water to be heated for which the temperature determined by the water-temperature-in-water-storage-tank sensing unit 410 is lower than and closest to the provision temperature, so that the heating unit 100 heats water at the largest actual COP. That is, the outlet selecting unit 430 efficiently selects one from the outlets for water to be heated through a simple comparison.

As described above, an outlet for water to be heated is selected based on a provision temperature and temperatures of water to be taken out through the outlets for water to be heated, and the water taken out through the outlet for water to be heated is heated. For example, the water having a temperature below the provision temperature is not usable for handling a load. An outlet for water to be heated is thus selected based on the provision temperature, so that the water which is in the water storage tank 210 but not usable for handling a load is efficiently taken out to be heated. As a result, the increase in the amount of water which is in the water storage tank 210 but not usable for handling a load is suppressed and the increase in available heat in the water storage tank 210 is increased, thus efficiency of operation is increased.

It is to be noted that although the "temperatures of water to be taken out through one of the outlets for water to be heated"

are defined as temperatures sensed by the temperature sensors 223 to 225 in the vicinity of the respective outlets for water to be heated 1 to 3, they may alternatively be temperatures of water sensed at any point between the vicinity of the outlets for water to be heated 1 to 3 and a point where water is entering the heating unit 100.

In the case where temperature at the point where water is entering the heating unit 100 is used as temperature of water to be taken out through one of the outlets for water to be heated, temperatures to be compared with the provision temperature may be obtained by subtracting, from temperatures sensed by the temperature sensors in the vicinity of the respective outlets for water to be heated, temperatures equivalent to heat loss between the temperature sensors in the vicinity of the respective outlets for water to be heated and the point where water is entering the heating unit 100.

Alternatively, because the heat loss before the point where water is entering the heating unit 100 depends on seasons and ambient conditions, heat loss values may be preset for respective seasons, or may be calculated from the difference from temperature sensed by the temperature sensors in the vicinity of the respective outlets for water to be heated and temperature sensed by the incoming water temperature sensor 122 for each season.

For example, the difference between the temperatures, which depends on installation conditions of the hot water supplying unit 20, seasons, and ambient conditions, will be 1° C. to 5° C.

Embodiment 2

The following describes a storage hot water supplying apparatus according to Embodiment 2 of the present invention.

In Embodiment 1, an outlet for water to be heated through which water having a temperature lower than and closest to the provision temperature is taken out is selected from among the outlets for water to be heated 1 to 3. On the other hand, in Embodiment 2, an outlet for water to be heated which provides the largest actual COP among the outlets for water to be heated 1 to 3 is selected based on calculated actual COPs.

Here, it is a property of a heat pump that performance of a heat pump depends on outside air temperature, entering water temperature, and target temperature.

Figure 9:
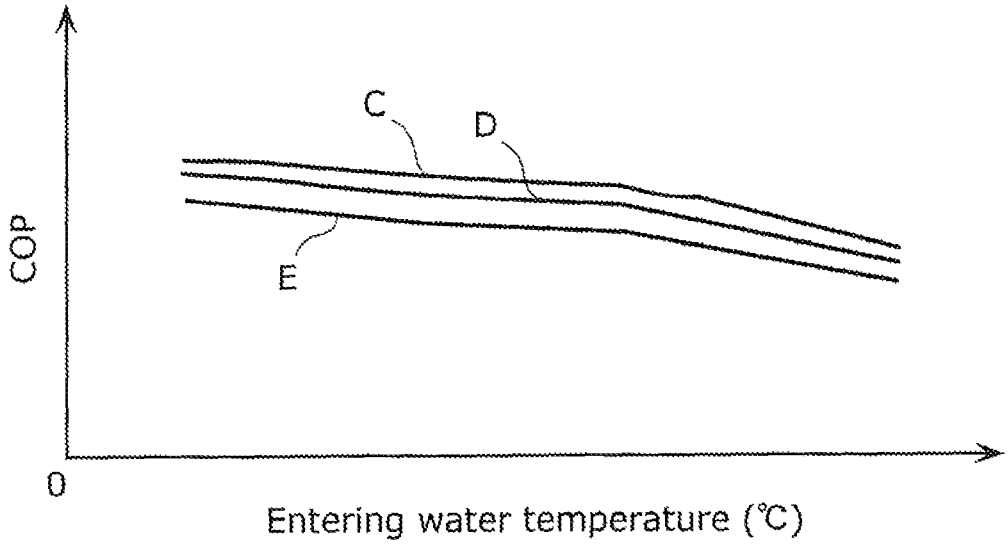
FIG. 9 shows COPs with respect to entering water temperatures for outside air temperatures.

FIG. 9 shows COPs with respect to entering water temperatures against outside air temperatures. Specifically, FIG. 9 shows a graph having a horizontal axis which represents temperatures of the water entering the heating unit 100 (entering water temperatures), and a vertical axis which represents COPs of the heating unit 100 for a constant target temperature.

Specifically, a graph C is a graph for summer, a graph D is a graph for intermediary seasons (spring and fall), and a graph E is a graph for winter. As shown in FIG. 9, the performance (COPs) depends on seasons (outside air temperature) even for the same target temperature and the same entering water temperature. The following describes Embodiment 2, in which an outlet for water to be heated which provides the largest actual COP among the outlets for water to be heated 1 to 3 is selected in accordance with properties of the heat pump which depend on outside air temperature, entering water temperature, and target temperature.

Figure 10:
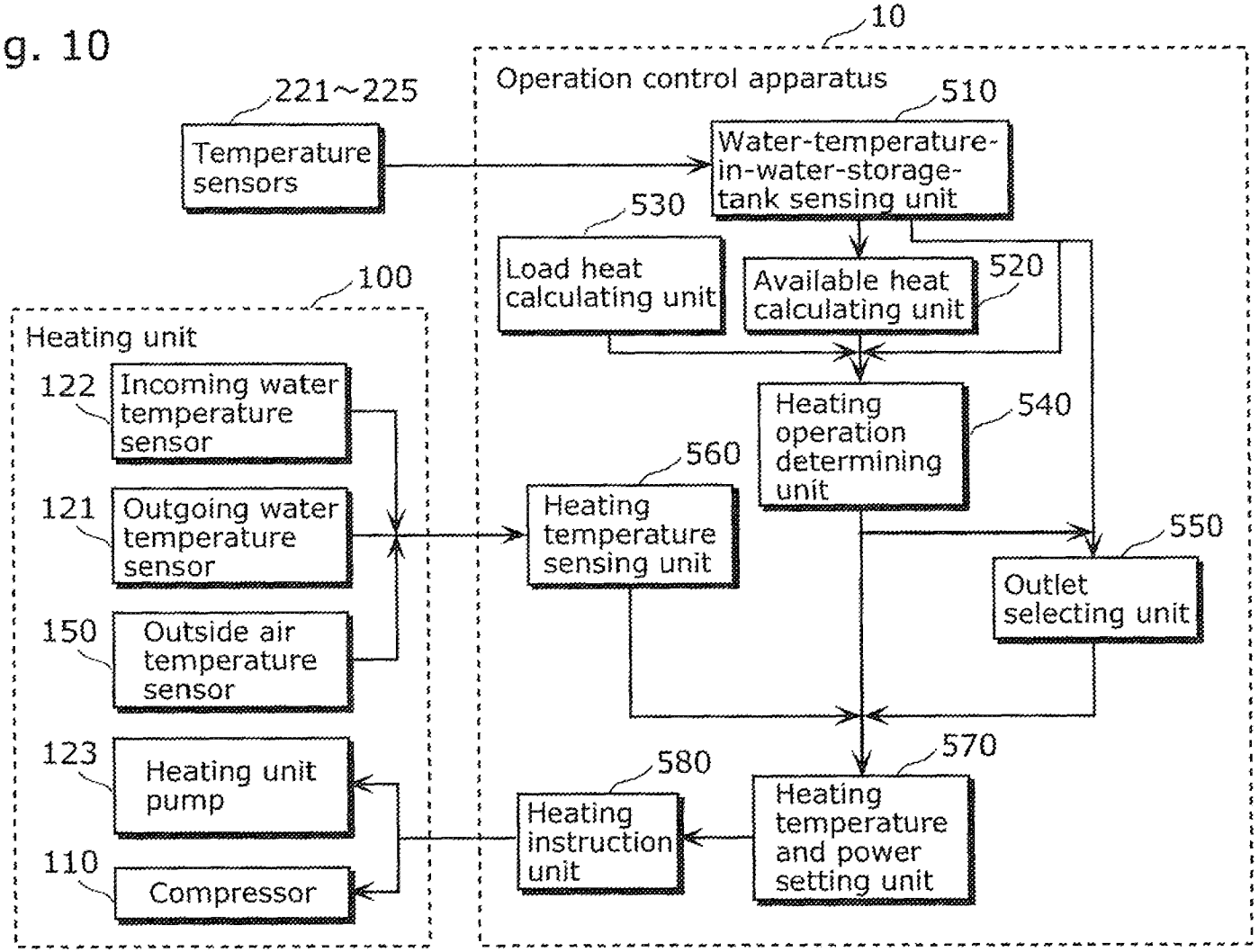
FIG. 10 is a functional block diagram showing a functional configuration of an operation control apparatus according to Embodiment 2 of the present invention.

FIG. 10 is a functional block diagram showing a functional configuration of the operation control apparatus 10 according to Embodiment 2 of the present invention.

As shown in FIG. 10, the operation control apparatus 10 includes a water-temperature-in-water-storage-tank sensing unit 510, an available heat calculating unit 520, a load heat calculating unit 530, a heating operation determining unit 540, an outlet selecting unit 550, a heating temperature sensing unit 560, a heating temperature and power setting unit 570, and a heating instruction unit 580.

The water-temperature-in-water-storage-tank sensing unit 510 determines the temperature of the water in the water storage tank 210. Specifically, the water-temperature-in-water-storage-tank sensing unit 510 obtains and holds temperatures of the water sensed by the temperature sensors 221 to 225 in the water storage tank 210.

The load heat calculating unit 530 obtains information regarding loads in the load circuit 300, such as hot water supply, space heating, and bathwater reheating, and calculates and holds the load heat.

The heating temperature sensing unit 560 determines the temperature of the water before and after being heated by the heating unit 100. Specifically, the heating temperature sensing unit 560 obtains the temperatures sensed by the incoming water temperature sensor 122, the outgoing water temperature sensor 121, and the outside air temperature sensor 150 of the heating unit 100.

The available heat calculating unit 520 calculates an available heat stored in the water storage tank 210 based on the water temperature determined by the water-temperature-in-water-storage-tank sensing unit 510.

The heating operation determining unit 540 determines start and stop of the heating operation by the heating unit 100 based on the temperature determined by the water-temperature-in-water-storage-tank sensing unit 510. Specifically, the heating operation determining unit 540 determines whether or not the heating unit 100 needs to be started and how long the heating operation needs to be continued, based on the available heat calculated by the available heat calculating unit 520 and the load heat calculated by the load amount of heat calculating unit 530, and, when the heating unit 100 is performing the heating unit 100, determines whether or not the heating operation needs to be stopped based on the temperature determined by the water-temperature-in-water-storage-tank sensing unit 510.

Next, the outlet selecting unit 550 selects, from among the outlets for water to be heated 1 to 3, an outlet for water to be heated through which to take out the water, based on a provision temperature and temperatures of water to be taken out through the outlets for water to be heated 1 to 3. That is, the outlet selecting unit 550 selects an outlet for water to be heated which provides the largest actual COP among the outlets for water to be heated 1 to 3. The COPs, which indicate energy efficiency in heating of water by the heating unit 100, are calculated using an assumed amount of heat which is smaller than an actual amount of heat of water having a temperature lower than the provision temperature.

Specifically, the outlet selecting unit 550 selects an outlet for water to be heated which provides the largest actual COP among the outlets for water to be heated 1 to 3, based on an assumption that the amount of heat of water having a temperature lower than the provision temperature is zero. Furthermore, specifically, the outlet selecting unit 550 selects an outlet for water to be heated based on the result of the determination made by the heating operation determining unit 540 and the water temperature determined by the water-temperature-in-water-storage-tank sensing unit 510. The outlet selecting unit 550 will be described in detail later.

The heating temperature and power setting unit 570 sets the target temperature to which the water is heated and powers of the heating unit pump 123 and the compressor 110, based on the temperature of water determined by the water-temperature-in-water-storage-tank sensing unit 510, the outlet for water to be heated selected by the outlet selecting unit 550, the result of determination made by the heating operation determining unit 540, and the temperature information determined by the heating temperature sensing unit 560.

The heating instruction unit 580 instructs the heating unit 100 to heat the water which is taken out through the selected outlet for water to be heated and to be returned to the water storage tank 210.

Then, the heating unit 100 heats the water at the set heating temperature and heating powers according to the instruction. That is, the heating unit 100 heats the water to the target temperature at the power of the heating unit pump 123 and the compressor 110 set by the heating temperature and power setting unit 570.

The following describes the outlet selecting unit 550 in detail.

Figure 11:
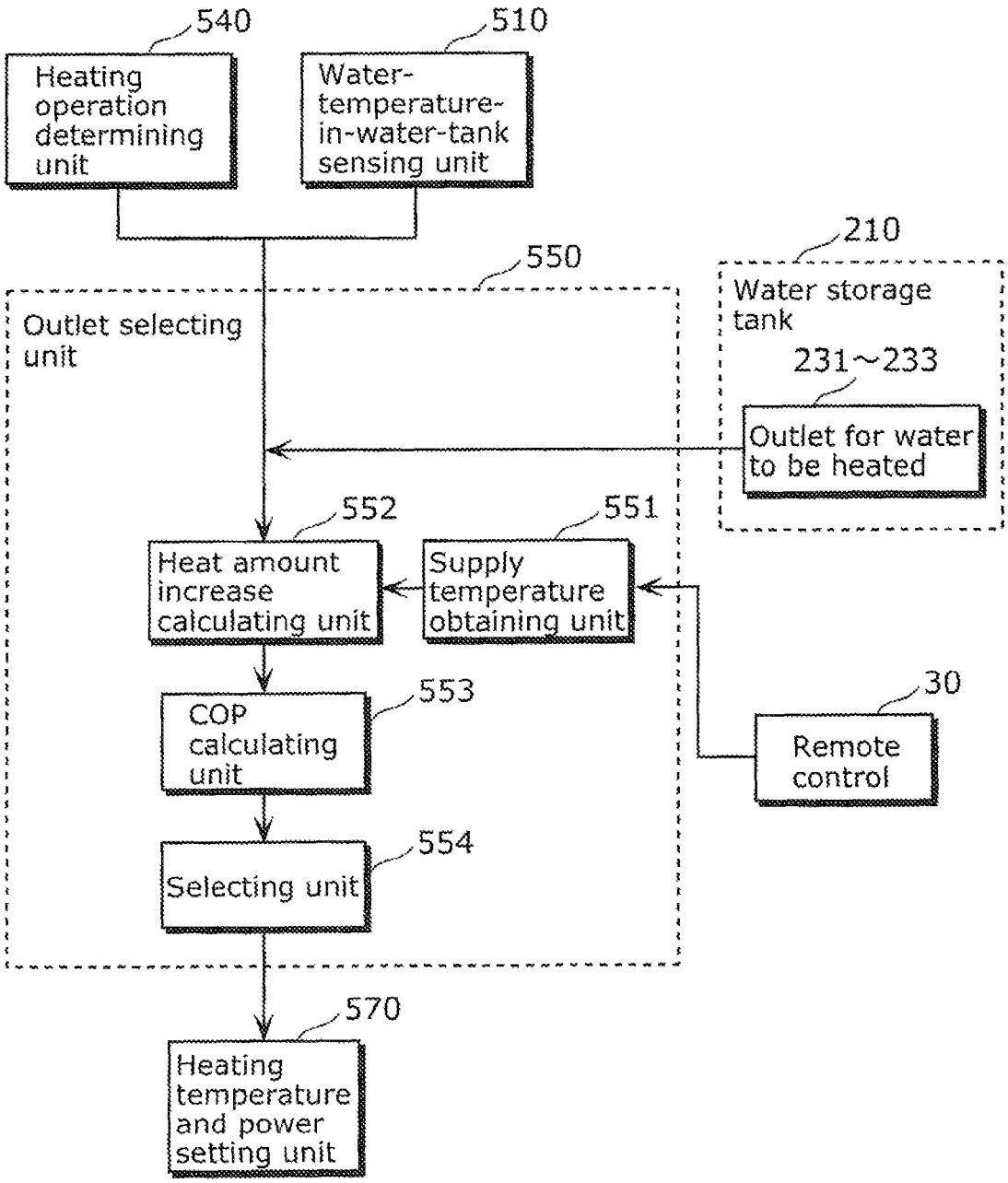
FIG. 11 is a functional block diagram showing a detailed functional configuration of an outlet selecting unit according to Embodiment 2 of the present invention.

FIG. 11 is a functional block diagram showing a detailed functional configuration of the outlet selecting unit 550 according to Embodiment 2 of the present invention.

As shown in FIG. 11, the outlet selecting unit 550 includes a provision temperature obtaining unit 551, a heat amount increase calculating unit 552, a COP calculating unit 553, and a selecting unit 554.

The provision temperature obtaining unit 552 obtains a provision temperature. The provision temperature obtaining unit 551 has the same function as the provision temperature obtaining unit 432 according to Embodiment 1.

The heat amount increase calculating unit 552 calculates an increase in available heat given to water to be taken out through each of the water-to-be-heated outlets 1 to 3 by the heating unit 100, based on an assumption that an amount of heat of the water to be taken out therethrough is zero in the case where the water has a temperature lower than the provision temperature.

Specifically, the heat amount increase calculating unit 552 calculates an increase in available heat for water taken out through each of the outlets for water to be heated 1 to 3, based on an assumption that the water is heated from the temperature determined by the water-temperature-in-water-storage-tank sensing unit 510 to the target temperature determined by the heating operation determining unit 540.

The COP calculating unit 553 calculates, for each of the outlets for water to be heated 1 to 3, an actual COP, which is a COP corresponding to the increase in the available heat calculated by the heat amount increase calculating unit 552.

The selecting unit 554 selects an outlet for water to be heated which provides the largest actual COP calculated by the COP calculating unit 553. Specifically, the selecting unit 554 compares the outlets for water to be heated 1 to 3 in terms of the actual COPs calculated by the COP calculating unit 553, and selects an outlet for water to be heated which provides the largest actual COP as an outlet for water to be heated through which to take out water in the water storage tank 210 to be sent to the heating unit 100 for heating.

The following describes an exemplary operation of the operation control apparatus 10 of the storage hot water supplying apparatus 1 according to Embodiment 2.

Figure 12:
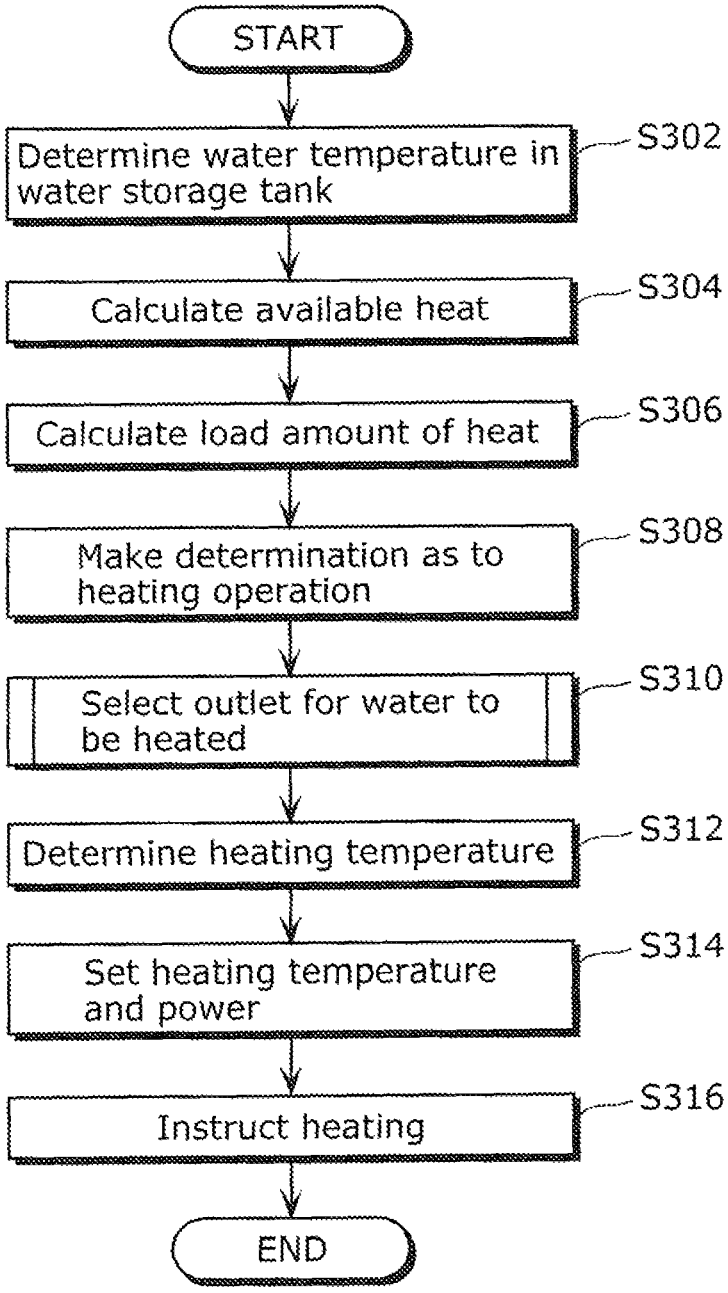
FIG. 12 is a flow chart showing an exemplary process of selecting an outlet for water to be heated performed by an outlet selecting unit according to Embodiment 2 of the present invention.

FIG. 12 is a flow chart showing an exemplary operation of the storage hot water supplying apparatus 1 according to Embodiment 2 of the present invention.

First, as shown in FIG. 12, the water-temperature-in-water-storage-tank sensing unit 410 determines the temperature of the water in the water storage tank 210 (S302).

Next, the available heat calculating unit 520 calculates an available heat stored in the water storage tank 210 based on the water temperature determined by the water-temperature-in-water-storage-tank sensing unit 510 (S304).

Next, the load heat calculating unit 530 calculates and holds the load heat to be used in the load circuit 300 (S306).

Next, the heating operation determining unit 540 determines start and stop of the heating operation by the heating unit 100, based on the temperature determined by the water-temperature-in-water-storage-tank sensing unit 510, the available heat calculated by the available heat calculating unit 520, and the load heat calculated by the load heat calculating unit 530 (S308).

Next, the outlet selecting unit 550 selects, from among the outlets for water to be heated 1 to 3, an outlet for water to be heated through which to take out the water, based on a provision temperature and temperatures of water to be taken out through the outlets for water to be heated 1 to 3 (S310). The process of selecting an outlet for water to be heated by the outlet selecting unit 550 will be described in detail later.

Next, the heating temperature sensing unit 560 determines the temperature of the water before and after being heated by the heating unit 100 (S312).

Next, the heating temperature and power setting unit 570 sets a heating temperature and a heating power of the heating unit 100 at which the heating unit 100 heats the water, based on the water temperature determined by the water-temperature-in-water-storage-tank sensing unit 510, the outlet for water to be heated selected by the outlet selecting unit 550, the result of the determination made by the heating operation determining unit 540, and the temperature determined by the heating temperature sensing unit 560 (S314).

Next, the heating instruction unit 580 instructs the heating unit 100 to heat the water which is taken out through the selected outlet for water to be heated and to be returned to the water storage tank 210 (S316). Then, the heating unit 100 heats the water at the set heating temperature and heating power according to the instruction.

The operation performed by the operation control apparatus 10 of the storage hot water supplying apparatus 1 according to Embodiment 2 is thus completed.

The following describes a process of selecting an outlet for water to be heated by the outlet selecting unit 550 (S310 in FIG. 12) in detail.

Figure 13:
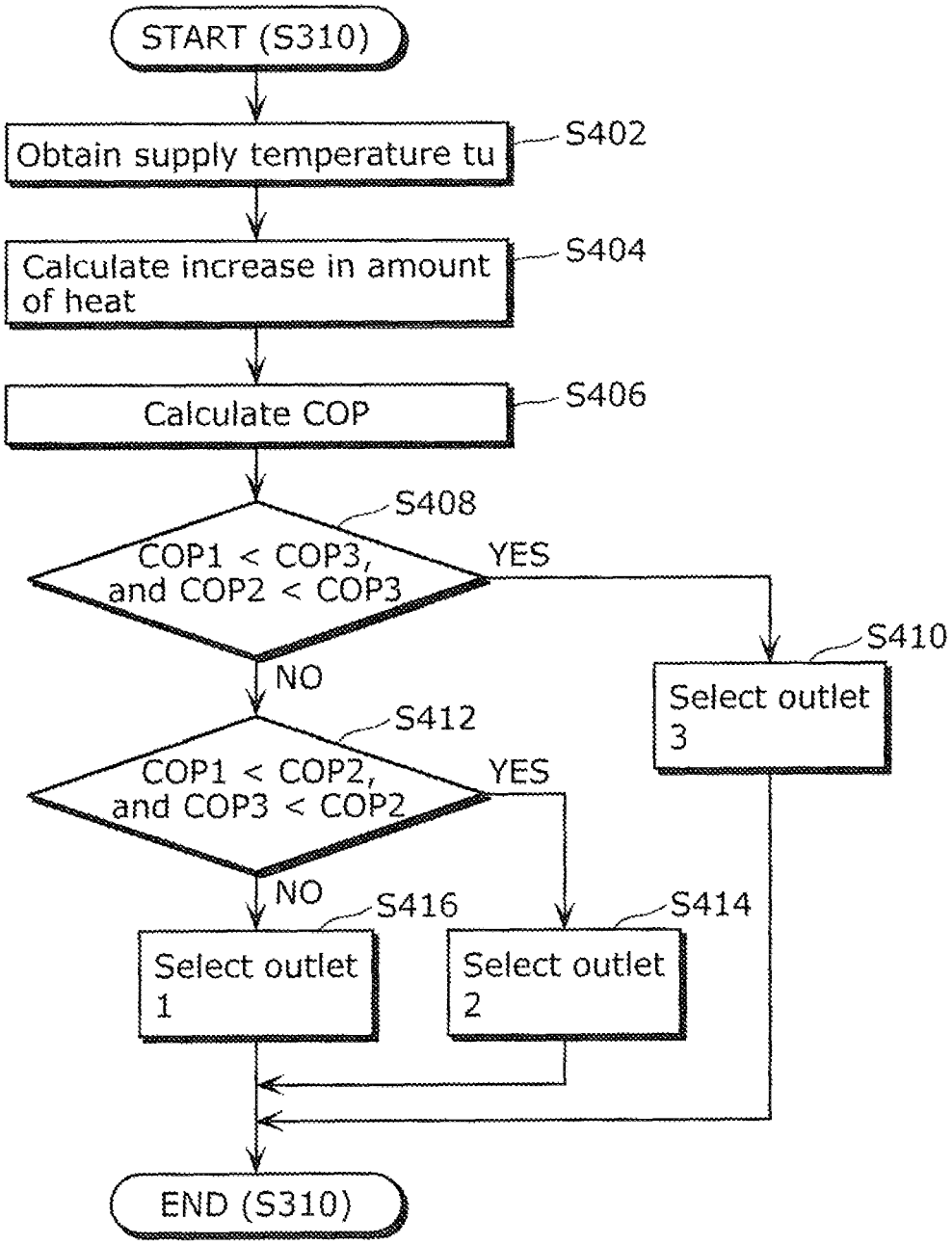
FIG. 13 is a flow chart showing an exemplary operation of the storage hot water supplying apparatus according to Embodiment 2 of the present invention.

FIG. 13 is a flow chart showing an exemplary process of selecting an outlet for water to be heated performed by the outlet selecting unit 550 according to Embodiment 2 of the present invention (S310 in FIG. 12).

First, referring to FIG. 13, the provision temperature obtaining unit 551 obtains a provision temperature to (S402).

Next, the heat amount increase calculating unit 552 calculates an increase in available heat given to water to be taken out through each of the water-to-be-heated outlets 1 to 3 by the heating unit 100, based on an assumption that an amount of heat of the water to be taken out therethrough is zero in the case where the water has a temperature lower than the provision temperature (S404).

Specifically, the heat amount increase calculating unit 552 calculates an increase in available heat for water taken out through each of the outlets for water to be heated 1 to 3, based on the provision temperature obtained by the provision temperature obtaining, unit 551, the target temperature determined by the heating operation determining unit 540, and the temperatures of water in the vicinity of the respective outlets for water to be heated 1 to 3 determined by the water-temperature-in-water-storage-tank sensing unit 510.

Here, the method of calculating an increase in available heat is the same as the method of calculating an increase in available heat represented by the graph B shown in FIG. 8.

That is, based on an assumption that available heat of water which is in the water storage tank 210 and has a temperature lower than the provision temperature is not usable for handling a load is zero, the increase in the available heat due to heating of the water is calculated from a target temperature to which the heating unit 100 heats the water and a flow rate thereof. At this time, the increase in available heat due to the heating of the water having a temperature equal to or above the provision temperature is the amount of heat corresponding to a difference between the target temperature and the temperature of the water in the water storage tank 210.

That is, the heat amount increase calculating unit 552 calculates an increase in available heat based on an assumption that in the case where water taken out through any of the water-to-be-heated outlets 1 to 3 has a temperature lower than the provisional temperature, water of zero available heat is heated, and in the case where water taken out through the water-to-be-heated outlets 1 to 3 has a temperature equal to or above the provision temperature, the water as is heated.

Next, the COP calculating unit 553 calculates an actual COP for each of the outlets for water to be heated 1 to 3 (S406).

Here, the method of calculating the actual COP is the same method as the method of calculating the COP shown in FIG. 8. That is, for the outlet for water to be heated 1, for example, the actual COP is calculated from an increase in available heat and a power consumption required for heating per unit time when the water in the vicinity of the water-to-be-heated outlet 1 is heated to the target temperature.

It is to be noted that the actual COP may be calculated from an increase in available heat due to heating of the water taken out through the outlet for water to be heated 1 to the target temperature and a power consumption required for the heating not per unit time but per unit volume based on an assumption that water of a unit volume is heated.

Next, the selecting unit 554 selects an outlet for water to be heated for which the COP calculating unit 553 has calculated the largest actual COP. That is, the selecting unit 554 compares the outlets for water to be heated 1 to 3 in terms of the actual COPs calculated by the COP calculating unit 553, and selects an outlet for water to be heated which provides the largest actual COP.

Specifically, the selecting unit 554 makes a comparison between the actual COP of the outlet for water to be heated 3 and the actual COPs of the outlet for water to be heated 1 and 2 (S408).

When determining that the actual COP of the outlet for water to be heated 3 (COP3) is larger than the actual COP of the outlet for water to be heated 1 (COP1) and the actual COP of the outlet for water to be heated 3 (COP3) is larger than the actual COP of the outlet for water to be heated 2 (COP2) (YES in S408), the selecting unit 554 selects the outlet for water to be heated 3 (S410).

When determining that the COP1 is equal to or larger than the COP3 or that the COP2 is equal to or larger than the COP3 (NO in S408), the selecting unit 554 makes a comparison between the actual COP of the outlet for water to be heated 2 and the actual COP of the outlet for water to be heated 1 and 3 (S412).

When determining that the COP2 is larger than the COP1 and the COP3 is larger than the COP2 (YES in S412), the selecting unit 554 selects the outlet for water to be heated 2 (S414).

When determining that the COP1 is equal to or larger than the COP2 or that the COP3 is equal to or larger than the COP2 (NO in S412), the selecting unit 554 selects the outlet for water to be heated 1 (S416).

The selecting unit 554 thus selects, from among the outlets for water to be heated 1 to 3, an outlet for water to be heated which provides the largest actual COP.

Such comparisons between calculated actual COPs accommodate differences in properties of a heat pump due to outside air temperature, entering water temperature, and target temperature, thus allowing use of an outlet for water to be heated which provides the largest actual COP for heating of water.

The provision temperature, which specifies the lower limit of the temperature of water usable for handling a load, may be predetermined according to a typical load or may be set to a value appropriate for conditions of actual use by an update according to the obtained and accumulated load heat.

The process of selecting an outlet for water to be heated performed by the outlet selecting unit 550 (S310 in FIG. 12) is thus completed.

In Embodiment 2, actual COPs are calculated based on an assumption that the amount of heat of water having a temperature lower than the provision temperature is zero, and an outlet for water to be heated which provides the largest actual COP is selected. That is, actual COPs are calculated based on an assumption that the available heat of water not usable for handling a load is zero. This allows selecting an outlet for water to be heated which provides the largest efficiency, and thus available heat in the water storage tank 210 is increased with the highest efficiency according to the properties of the heat pump.

Thus, the storage hot water supplying apparatus 1 according to the present invention operates at efficiency enhanced with a larger increase in available heat in the water storage tank 210.

The present invention is not limited to the storage hot water supplying apparatus 1 according to the present invention described in the above embodiments.

In other words, the embodiments disclosed herein are exemplary in all respects and should never be considered limiting. The scope of the present invention is indicated not by the description above but by the claims, and is intended to include any modification within the scope and the sense of equivalents of the claims.

For example, in the present embodiments, the provision temperature obtaining unit 432 obtains, as a provision temperature, a user's input of a temperature or a level set for water for hot water supply or water for heating into the storage hot water supplying apparatus 1 through the remote control 30. Alternatively, the provision temperature obtaining unit 432 may obtain a provision temperature which is directly input into the storage hot water supplying apparatus by a user without using the remote control 30. Alternatively, the provision temperature obtaining unit 432 may obtain, as a provision temperature, a temperature of water for hot water supply or water for heating sensed using a temperature sensor.

In the present embodiments, a provision temperature is the lowest one of the temperatures set for water for hot water supply and water for heating. Alternatively, a provision temperature is not limited to this. For example, a provision temperature may be the highest one of temperatures set for water for hot water supply and water for heating or an average temperature of temperatures set for water for hot water supply and water for heating. Alternatively, a user may determine a provision temperature as necessary regardless of temperatures set for water for hot water supply and water for heating.

In Embodiment 2, the outlet selecting unit 550 selects, from among the outlets for water to be heated 1 to 3, an outlet for water to be heated which provides the largest actual COP. Alternatively, the outlet selecting unit 550 may firstly select, from among the outlets for water to be heated 1 to 3, outlets for water to be heated through which to take out water having temperatures lower than the provision temperature, and then selects, from among the selected outlets for water to be heated through which water having temperatures lower than the provision temperature is to be taken out, an outlet for water to be heated which provides the largest actual COP.

In Embodiment 2, the outlet selecting unit 550 calculates an actual COP based on an assumption that the amount of heat of water having a temperature lower than the provision temperature is zero. Alternatively, the outlet selecting unit 550 may calculate an actual COP using, as the amount of heat of water having a temperature lower than a provision temperature, a predetermined amount of heat lower than an actual amount of heat of the water instead of using a value of zero.

Furthermore, the present invention may be implemented not only as the storage hot water supplying apparatus 1 but also as a hot water supplying and space heating apparatus which includes the processing units included in the storage hot water supplying apparatus 1, an operation control apparatus 10 which controls the storage hot water supplying apparatus 1, or as a method which includes the processing units included in these apparatuses as steps. It is also possible to implement the present invention as a program that causes a computer to execute the steps, as a computer medium, such as a computer-readable CD-ROM, on which the program is recorded, or as information, data, or a signal that represents the program. The program, the information, the data, and the signal may be distributed via a communication network such as the Internet.

The storage hot water supplying apparatus according to the present invention is applicable to a storage hot water supplying apparatus either with or without any type of space heating such as floor heating or a radiator, or either with or without bathwater reheating, and particularly to a heat-pump hot water supplying and space heating apparatus with a heat pump cycle using carbon dioxide as coolant. The storage hot water supplying apparatus according to the present invention is also applicable to a storage hot water supplying apparatus in which another coolant is used.

REFERENCE SIGNS LIST

1 Storage hot water supplying apparatus
10 Operation control apparatus
20 Hot water supplying unit
30 Remote control
100 Heating unit
110 Compressor
120 Water heat exchanger
121 Outgoing water temperature sensor
122 Incoming water temperature sensor
123 Heating unit pump
130 Expansion valve
140 Air heat exchanger
150 Outside air temperature sensor
200 Tank unit
210 Water storage tank
211 Heated-water inlet
221 to 225 Temperature sensors
231 to 233 Outlets for water to be heated
241 Hot water supplying load outlet
242 Circulating hot water outlet
251 to 253 Circulating hot water inlets
261 Makeup water inlet
271 to 274 Three-way valve
281, 282 Mixing valve
300 Load circuit
310 Hot water supplying unit
320 Circulating hot water heat exchanger
321 Hot water circulating pump
330 Space-heating and bathwater-reheating unit
331 Space-heating and bathwater-reheating pump
410 Water-temperature-in-water-storage-tank sensing unit
420 Heating operation determining unit
430 Outlet selecting unit
431 Outlet water temperature obtaining unit
432 Provision temperature obtaining unit
433 Selecting unit
440 Heating temperature sensing unit
450 Heating temperature and power setting unit
460 Heating instruction unit
510 Water-temperature-in-water-storage-tank sensing unit
520 Available heat calculating unit
530 Load heat calculating unit
540 Heating operation determining unit
550 Outlet selecting unit
551 Provision temperature obtaining unit
550 Heat amount increase calculating unit
553 COP calculating unit
554 Selecting unit
560 Heating temperature sensing unit
570 Heating temperature and power setting unit
580 Heating instruction unit

The invention claimed is:

1. A storage hot water supplying apparatus which provides a heated water to a load portion through which a user is provided water, the storage hot water supplying apparatus comprising:

a water storage tank which stores water and is provided with a plurality of water outlets through which the water is taken out for heating, the water outlets being positioned at different levels of the water storage tank and not being used to provide the heated water to the load portion;

an outlet selecting unit configured to select, from among the water outlets, a water outlet through which to take out the water, based on a provision temperature which is a temperature of water required by and to be provided to the load portion and temperatures of the water to be taken out through the water outlets as detected by respective temperature sensors proximate to each water outlet, the selection of the water outlet being made by sequentially comparing temperatures detected proximate to each water outlet with the provision temperature and selecting the water outlet having a temperature lower than the provision temperature; and a heating unit configured to heat the water taken out through the selected water outlet and to return the heated water to the water storage tank.

2. The storage hot water supplying apparatus according to claim 1, wherein the outlet selecting unit is configured to select a water outlet through which to take out water having a temperature lower than and closest to the provision temperature.

3. The storage hot water supplying apparatus according to claim 1, further comprising:

a hot water supplying load outlet which is formed on the water storage tank and through which high-temperature water stored in the water storage tank is taken out; and a mixing valve which mixes the high-temperature water taken out through the hot water supplying load outlet and water having a temperature lower than a temperature of the high-temperature water, wherein water resulting from the mixing by the mixing valve is provided to the load portion.

4. The storage hot water supplying apparatus according to claim 1, further comprising a water temperature sensing unit configured to sense a temperature of the water to be taken out through each of the water outlets.

5. The storage hot water supplying apparatus according to claim 1, wherein the load portion is provided with water for hot water supply or water for heating, the water for hot water supply being water to be supplied to the user, and the water for heating being water to be provided to an apparatus for space heating or an apparatus for bathwater reheating, and the storage hot water supplying apparatus further comprises a provision temperature setting unit configured to receive one of a temperature set for the water for hot water supply and a temperature set for the water for heating, and to set the received temperature as the provision temperature.

6. The storage hot water supplying apparatus according to claim 1, further comprising a heated-water inlet which is formed on the water storage tank and allows the water taken out through the selected water outlet and heated by the heating unit to return to the water storage tank, wherein the heated-water inlet is positioned higher than the water outlets.

7. The storage hot water supplying apparatus according to claim 1, wherein the heating unit includes a heat pump which heats water.

8. The storage hot water supplying apparatus according to claim 1, wherein the outlet selecting unit is configured to select a water outlet which provides a largest coefficient of performance (COP), the COP indicating energy efficiency in heating of water by the heating unit and being calculated using an assumed amount of heat which is smaller than an actual amount of heat of water having a temperature lower than the provision temperature.

9. The storage hot water supplying apparatus according to claim 3, wherein the outlet selecting unit comprises:

a heat amount increase calculating unit configured to calculate, for each of the water outlets, an increase in an amount of heat of the water to be taken out through the water outlet due to heating of the water by the heating unit, the increase being calculated based on an assumption that an amount of heat of the water is zero in the case where the water has a temperature lower than the provision temperature;

a coefficient of performance (COP) calculating unit configured to calculate, for each of the water outlets, a COP corresponding to the calculated increase in the amount of heat; and a selecting unit configured to select a water outlet for which the calculated COP is largest among the water outlets.

10. The storage hot water supplying apparatus according to claim 1, wherein the load portion is provided with water for hot water supply or water for heating, the water for hot water supply being water to be supplied to the user, and the water for heating being water to be provided to an apparatus for space heating or an apparatus for bathwater reheating, and the outlet selecting unit is configured to select, from among the plurality of water outlets, a water outlet through which to take out the water, based on the provision temperature which is one of a temperature set for the water for hot water supply and a temperature set for the water for heating.

11. The storage hot water supplying apparatus according to claim 10, wherein the outlet selecting unit is configured to select the water outlet based on the provision temperature which is a lowest one of the temperature set for the water for hot water supply and the temperature set for the water for heating.

12. The storage hot water supplying apparatus according to claim 1, further comprising:

a water-temperature-in-water-storage-tank sensing unit configured to determine a temperature of the water stored in the water storage tank;

a heating temperature sensing unit configured to determine temperatures of the water before and after being heated by the heating unit;

a heating operation determining unit configured to determine start and stop of heating of the water by the heating unit, based on the temperature determined by the water-temperature-in-water-storage-tank sensing unit; and a heating temperature and power setting unit configured to set a heating temperature and a heating power of the heating unit, based on the temperature determined by the water-temperature-in-water-storage-tank sensing unit, the temperatures determined by the heating temperature sensing unit, a result of the determination made by the heating operation determining unit, and the water outlet selected by the outlet selecting unit, wherein the heating unit is configured to heat the water at the set heating temperature and the set heating power.

13. An operation control apparatus for controlling a storage hot water supplying apparatus which provides a heated water to a load portion through which a user uses water, the storage hot water supplying apparatus including:

a water storage tank which stores water and is provided with a plurality of water outlets through which the water is taken out for heating, the water outlets being positioned at different levels of the water storage tank and not being used to provide the heated water to the load portion; and a heating unit configured to heat the water taken out through the water outlets and to be returned to the water storage tank, and the operation control apparatus comprising:

an outlet selecting unit configured to select, from among the water outlets, a water outlet through which to take out the water, based on a provision temperature which is a temperature of water required by and to be provided to the load portion and temperatures of the water to be taken out through the water outlets as detected by respective temperature sensors proximate to each water outlet, the selection of the water outlet being made by sequentially comparing temperatures detected proximate to each water outlet with the provision temperature and selecting the water outlet having a temperature lower than the provision temperature; and a heating instruction unit configured to instruct the heating unit to heat the water taken out through the selected water outlet and to return the heated water to the water storage tank.

14. An operation control method for controlling a storage hot water supplying apparatus which provides a heated water to a load portion through which a user uses water, the storage hot water supplying apparatus including:

a water storage tank which stores water and is provided with a plurality of water outlets through which the water is taken out for heating, the water outlets being positioned at different levels of the water storage tank and not being used to provide the heated water to the load portion; and a heating unit configured to heat the water taken out through the water outlets and to be returned to the water storage tank, and the operation control method comprising:

selecting, from among the water outlets, a water outlet through which to take out the water, based on a provision temperature which is a temperature of water required by and to be provided to the load portion and temperatures of the water to be taken out through the water outlets as detected by respective temperature sensors proximate to each water outlet, the selection of the water outlet being made by sequentially comparing temperatures detected proximate to each water outlet with the provision temperature and selecting the water outlet having a temperature lower than the provision temperature; and instructing the heating unit to heat the water taken out through the selected water outlet and to return the heated water to the water storage tank.

15. A program recorded on a non-transitory computer-readable recording medium for controlling an operation of a storage hot water supplying apparatus which provides a heated water to a load portion through which a user uses water, the storage hot water supplying apparatus including:

a water storage tank which stores water and is provided with a plurality of water outlets through which the water is taken out and heated, the water outlets being positioned at different levels of the water storage tank and not being used to provide the heated water to the load portion; and a heating unit configured to heat the water taken out through the water outlets and to be returned to the water storage tank, and the program causing a computer to execute:

selecting, from among the water outlets, a water outlet through which to take out the water, based on a provision temperature which is a temperature of water required by and to be provided to the load portion and temperatures of the water to be taken out through the water outlets as detected by respective temperature sensors proximate to each water outlet, the selection of the water outlet being made by sequentially comparing temperatures detected proximate to each water outlet with the provision temperature and selecting the water outlet having a temperature lower than the provision temperature; and instructing the heating unit to heat the water taken out through the selected water outlet and to return the heated water to the water storage tank.

* * * * *